US007896363B2

(12) United States Patent
Lovejoy

(10) Patent No.: US 7,896,363 B2
(45) Date of Patent: Mar. 1, 2011

(54) ICE SKATE

(76) Inventor: Kristy Lovejoy, Englewood, CA (US)

( * ) Notice: Subject to any disclaimer, the term of this patent is extended or adjusted under 35 U.S.C. 154(b) by 170 days.

(21) Appl. No.: 12/126,484

(22) Filed: May 23, 2008

(65) Prior Publication Data

US 2009/0289427 A1 Nov. 26, 2009

(51) Int. Cl.
*A63C 17/18* (2006.01)

(52) U.S. Cl. ..... 280/7.13; 280/841; 280/11.12; 280/11.18

(58) Field of Classification Search ..... 280/11.18, 280/11.12, 11.15, 11.16, 7.14, 11.19, 11.14, 280/7.13, 841, 600
See application file for complete search history.

(56) References Cited

U.S. PATENT DOCUMENTS

| | | | | |
|---|---|---|---|---|
| 3,934,892 | A * | 1/1976 | Baikie | 280/11.12 |
| 4,074,909 | A * | 2/1978 | Baikie | 280/11.12 |
| 4,218,069 | A | 8/1980 | Baikie | |
| 4,353,562 | A | 10/1982 | Tiefenthal | |
| D275,218 | S | 8/1984 | Chang | |
| 4,907,813 | A | 3/1990 | Hall | |
| 5,320,366 | A * | 6/1994 | Shing | 280/7.14 |
| 5,484,148 | A | 1/1996 | Olivieri | |
| 5,971,405 | A * | 10/1999 | Edauw | 280/11.14 |
| 6,082,744 | A | 7/2000 | Allinger et al. | |
| 6,109,622 | A * | 8/2000 | Reynolds | 280/11.17 |
| 6,193,243 | B1 | 2/2001 | Johannes Meester et al. | |
| 6,234,532 | B1 | 5/2001 | Kollen | |
| 6,467,778 | B1 * | 10/2002 | Goldsmith et al. | 280/11.12 |
| 6,523,835 | B1 * | 2/2003 | Lyden | 280/11.12 |
| 6,817,618 | B2 | 11/2004 | Furzer et al. | |
| 6,932,361 | B2 * | 8/2005 | Steinhauser, Jr. | 280/11.18 |
| 6,988,735 | B2 * | 1/2006 | Furzer et al. | 280/11.12 |
| 7,380,801 | B2 * | 6/2008 | Rudolph | 280/11.18 |
| 7,648,146 | B2 * | 1/2010 | Tatomir | 280/11.18 |
| 7,673,884 | B2 * | 3/2010 | Wuerthner | 280/11.18 |

OTHER PUBLICATIONS

The Parabolic from John Wilson and MK, www.theworldsbestblades.com/parabolic.html, available as early as May 19, 2008, 3 pages.

* cited by examiner

*Primary Examiner* — Hau V Phan
(74) *Attorney, Agent, or Firm* — SAIDMAN DesignLaw Group

(57) ABSTRACT

The present disclosure is directed to an ice skate including a boot, a separately formed casing, a blade, and a fastener. The boot includes a boot chamber for receiving a skater's foot. The casing includes an upper portion, a sole plate, and a blade holder. The upper portion defines a casing chamber for receiving the boot. In one example, the casing is plastic. The sole plate includes abutting toe, arch and heel areas and has a cantilevered connection to the blade holder. In this cantilevered connection, the toe and arch areas of the sole plate are supported by the blade holder and the heel area is unsupported by the blade holder. The blade holder defines a slot for selectively receiving the blade. The fastener removably secures the blade to the blade holder. In one example, the blade further includes a toe pick for use in figure skating.

21 Claims, 18 Drawing Sheets

FIG. 9A
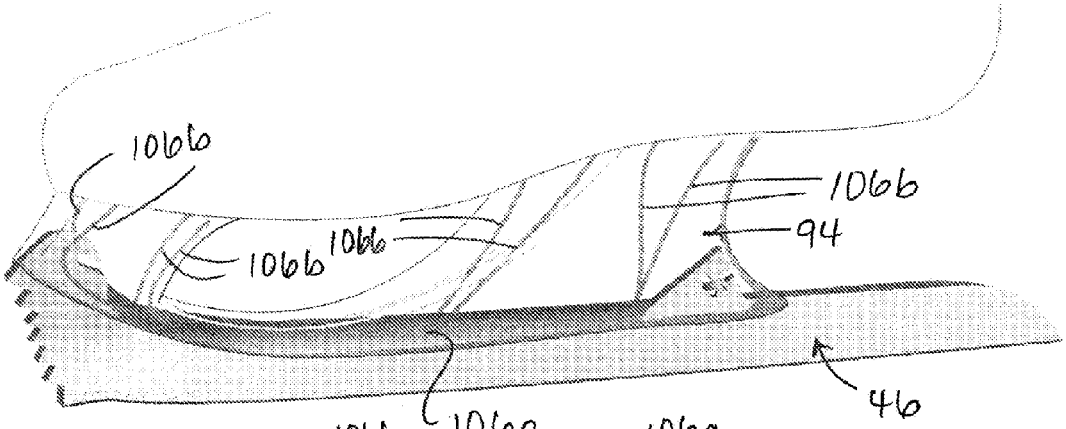
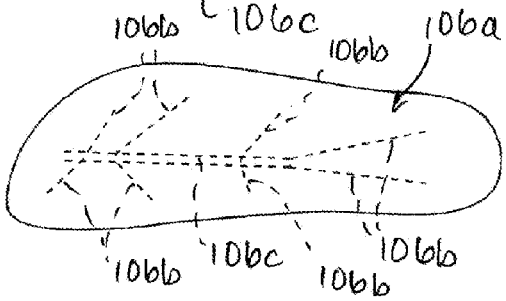
FIG. 9B
FIG. 9C
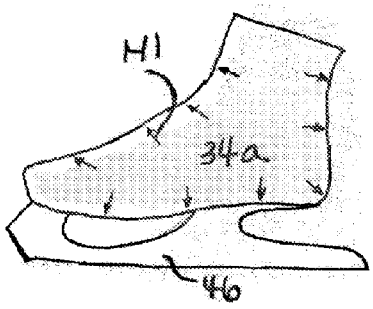
FIG. 9D
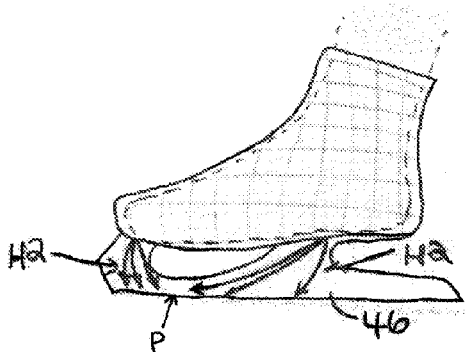

ICE SKATE

BACKGROUND OF THE DISCLOSURE

1. Field of the Disclosure

The present disclosure provides an ice skate. More particularly, the present disclosure provides an ice skate including a casing with a cantilevered sole plate.

2. Description of Related Art

Ice skates for figure skating, also known as figure skates, are well-known. As shown in FIG. 1, prior art figure skate 10 includes boot 12 and attached blade 14. Boot 12 is formed of leather upper 15 with laces 16 to tighten upper 15 with a tongue (not shown) about a user's foot (not shown). Boot 12 further includes sole 17 with 1½" heel 18 therebelow at the rear end. Heel 18 allows skate 10 to have pitch angle δ between top surface S of sole 17 at heel 18 and horizontal plane H parallel to the ground/ice of between about 5 degrees to about 9 degrees.

Blade 14 is formed of metal and includes toe pick 20, three stanchions 22, toe plate 24, and heel plate 26. Stanchions 22 extend from toe plate 24 and heel plate 26, which each include apertures (not shown) for receiving up to twelve screws (not shown). Thus, blade 14 is removably connected to sole 17 of boot 12 in the toe/ball area and the heel area. Arch support is provided by a separate foot bed insert (not shown).

Beginning skaters experience various problems due to the configuration of conventional skates. For advanced or elite skaters, with the increased demands of jumping, these problems are multiplied. Jumps require greater ankle support as a result; advanced skaters wear prior art skates with several layers of leather and padding around the ankle between these layers. This increases stiffness of the skates and increases their weight. The stiffness provides ankle support, but decreases forward bendability and shock absorption. Upon landing jumps, prior art figure skates do not have any shock absorption qualities other than cushioning on the inside of the boot.

Heel 18 on boot 12 can cause retrocalcaneal bursitis (also known as "pump bumps" or Haglund's deformity), shin splints, bunions, hammer toes, ankle and lower calf tendonitis, back and hip pain, instances of enlarged navicular bone in the arch potentially leading to collapsed arches, knee tracking problems, and arthritis.

In addition, the prior art skates are heavy, weighing up to six pounds each. Thus, these skates require skaters to have the endurance and strength to jump lifting this additional weight. Prior art blades weigh from about 4.5 ounces to about 7 ounces. Furthermore, since leather absorbs water, the weight of the skates increases with wear. If the weight is more than 5% of the skater's weight, it could potentially increase the skater's risk of injury.

Rust and leather rot are also common with conventional figure skates. These conditions lead to disintegration of the blade and boot, which decreases the life of both.

A lot of maintenance is necessary to maintain these skates in good working order. For example, these skates must be dried thoroughly inside and out after each use, stored in a place with good air circulation, the leather soles must be waxed, and the uppers must be waxed or polished. In addition, the soles must be frequently inspected for rot, screws must be replaced, hole damage repaired, and the blades must be sharpened. It is desirable to reduce the amount of maintenance necessary to keep skates in good working order.

The stress imparted on the blade and boot connection loosens over time and may shorten boot and blade life. If the blade and boot connection fails, the boot can be damaged. As a result, frequent inspections of this connection are routine.

Since each skater has different needs and preferences, advanced skates have handmade boots. The handmade nature of the boots causes nearly 20% of them to be defective, which may lead to substandard skate performance and foot damage. Furthermore, since blades and boots are not sold as a unit, advanced skaters must purchase their blades and boots separately. Then, an expert has to mount the blades to the boots. This requires added time and money.

One drawback of these prior art skates is that the leather upper must be broken in. This is when the leather is stretched by a user wearing the boot until it conforms to the shape of the skater's foot and ankle. Breaking in skates can be time consuming and painful. If boots are not broken in properly, they can crease in the wrong places causing pain and improper support of the foot and ankle. Even when boots are broken in properly, the leather upper is stiff and somewhat uncomfortable.

The industry standard for boot replacement depends on how much a skate is used. For advanced or elite skaters, who use their skates more, replacement is recommended every 6 to 12 months. For beginner skaters, who use their skates less, replacement is recommended every 12-18 months. Wearing a boot beyond these recommended time frames may cause "lace bite" and other health issues. "Lace bite" is the name for calluses and bursitis on the top of the foot caused by tongue breakdown.

Therefore a need exists for improving the comfort and performance of ice skates. More particularly, a need exists for ice skates that support foot, ankle, knee, hip and back health. In addition, a need exits for a skate that lasts longer, requires less maintenance, and can have more automation in the manufacturing process.

SUMMARY OF THE DISCLOSURE

In one example the present ice skate comprises a casing and a blade. The casing includes an upper portion and a sole plate defining a casing chamber for receiving a skater's foot. The sole plate has abutting toe, arch and heel areas. The casing further includes a blade holder. The sole plate is supported by the blade holder at the toe area and the sole plate is unsupported by the blade holder at the heel area. The blade is removably connected to the blade holder.

In another example, the ice skate further includes the sole plate being supported by the blade holder at the arch area. In such exemplary skate, blade holder may include first and second supports joined by a neck portion. The sole plate being supported by the first support at the toe area and the sole plate being supported by the second support at the arch area. Furthermore in such exemplary skate, the first support of the blade holder includes a front wall, and when the blade is connected to the blade holder the front wall extends over a leading edge of the blade.

In yet another example, the blade holder further defines a slot and the blade is selectively disposable within the slot. Additionally, an exemplary ice skate further includes a fastener for removably connecting the blade to the blade holder.

In one example, the upper portion, the sole plate, and the blade holder are integrally formed. In such example, the upper portion, the sole plate, and the blade holder may be formed of plastic material. Furthermore in such example, the upper portion may include a heel counter and a toe box. The toe box includes a top wall and a joined front wall. The heel counter and top wall are formed of a first plastic material. The front wall, the sole plate and the blade holder are formed of a second plastic material different from the first plastic material. The upper portion may further include a strap between the heel counter and the toe box, the strap defining spaced apart openings.

The ice skate further includes a boot separate from the casing, the boot defining a boot chamber for receiving the skater's foot and being received in the casing chamber. In such a skate the boot may includes an outer layer formed of a first boot material, an inner layer formed of a second boot material and an intermediate layer between the outer and inner layers formed of a third boot material. The third boot material has stiffness greater than the first and second boot materials.

According to another aspect of the disclosure, the ice skate comprises a boot defining a boot chamber for receiving a skater's foot, a casing, and a blade. The casing includes an upper portion and a sole plate defining a casing chamber for receiving the boot. The sole plate has abutting toe, arch and heel areas. The casing further includes a blade holder, and the sole plate has a cantilevered connection to the blade holder such that the heel area is unsupported by the blade holder. The blade being removably connected to said blade holder.

According to another aspect of the present disclosure, the blade further includes a toe pick.

The present exemplary ice skates have numerous advantages over the prior art skates. Firstly, removal of leather boot, heel, and steel plates allow exemplary skates to weigh less than 5 pounds and more preferably about 1.5 pounds each. Weight reduction reduces skater fatigue and may allow for increased jump height.

Boot materials, plastic casing and dual lace design allow a closer, more comfortable fit than prior art ice skates. In addition, the elimination of leather from the boot increases product life by eliminating leather rot and reduces maintenance. Furthermore, elimination of leather boot reduces or eliminates the need to break in the boot.

Since there are fewer fastener holes, the likelihood of rust is also reduced, which also increases product life. Skate maintenance is reduced, due to materials used, direct connection between blade and fastener (no connection of fastener into sole plate), and the reduction in the number of fasteners. In addition reduction of mechanical fasteners and metal decreases the chances of a malfunction. The blade/blade holder connection also makes blades easily replaced or interchanged. The present design also allows the skate to come preassembled with the blade already connected to the casing.

Health benefits anticipated are due to, for example, elimination of heel, elimination of leather boot, and cantilevered shock-absorbing sole plate. Health benefits anticipated include reducing the following: ankle bursitis, calluses, nerve trauma associated with laces, "lace bite", "pump bumps", enlarged navicular bone in arch, bunions, hammer toes, ankle or lower calf tendonitis, back and/or hip pain, knee tracking problems, arthritis, shin splints.

Performance benefits of the present skate include the following: reduced skater fatigue related to reduced weight of skate and/or reduced friction using heat conduit, reduced cardiovascular effort, may increase in jump height due to weight reduction, elimination of heel may increase jump height by allowing full calf extension, and increased plantar flexion may allow for higher jumps and softer landings.

The sculptural beauty of present skate allows it to be more aesthetically pleasing than the prior art skate. The present skate allows for uninterrupted or clean lines and the visual transition from blade to foot minimizes impact of skate so that audience can focus more on skater.

BRIEF DESCRIPTION OF THE DRAWINGS

FIG. 9A is a medial, perspective, view of the right skate of FIG. 7 showing a heat conduit assembly;

FIG. 9B is a top view of the heat conduit assembly of FIG. 9A;

FIGS. 9C-D are medial side views of the skate of FIG. 9 showing the heat conduit assembly in use;

FIG. 10 is a cross-sectional view of casing, blade and fastener of FIG. 7 with blade in an uninstalled state;

DETAILED DESCRIPTION

Figure 2:
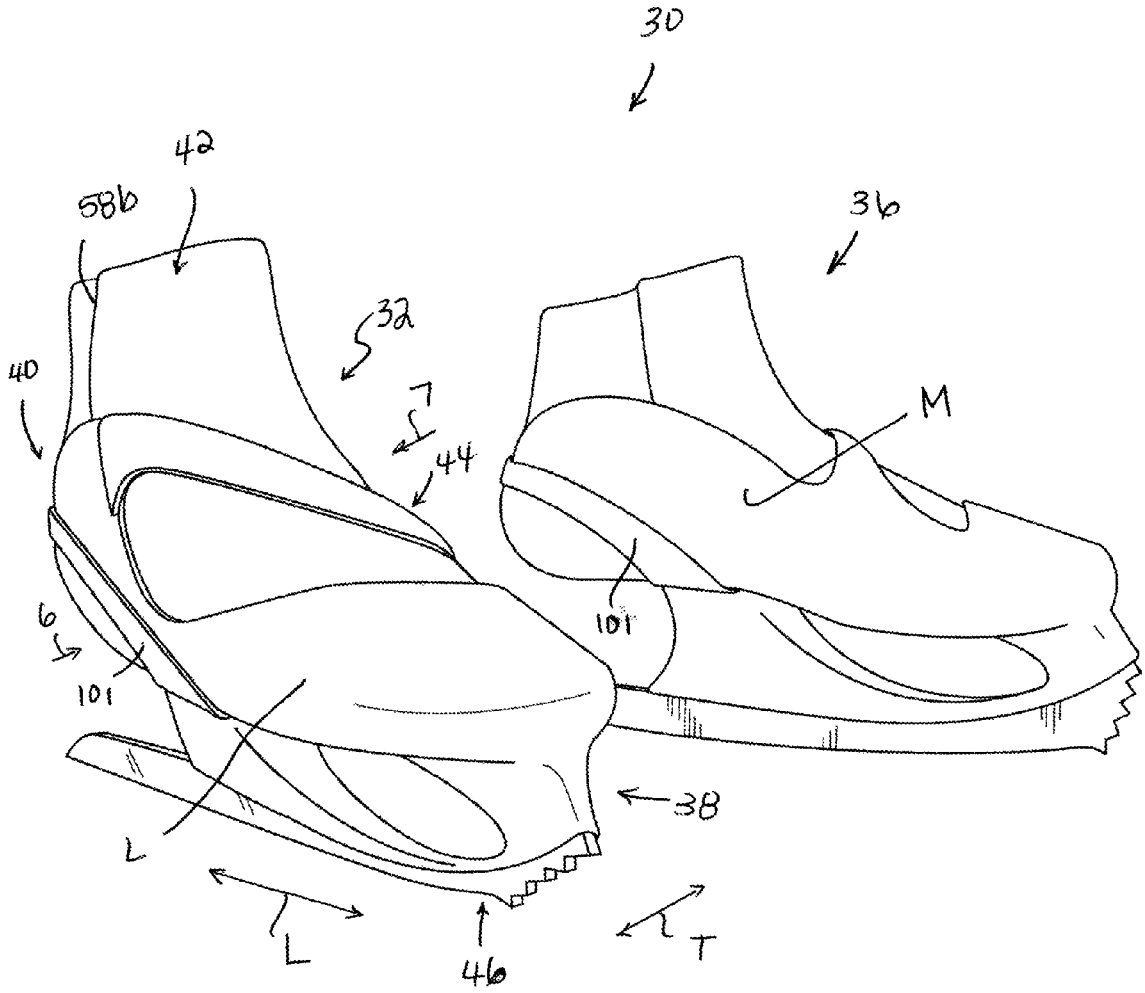
FIG. 2 is a front, perspective view of a first example of a pair of ice skates.

Referring to FIG. 2, first example of pair of ice skates 30 is shown. Pair of skates 30 includes right ice skate 32 for skater's right foot and leg 34*a,b* (shown in phantom in FIG. 4) and left ice skate 36 for a skater's left foot and leg (not shown). Pair of skates 30 is usable by a wearer to glide and perform various maneuvers on ice. The components for left skate 36 are mirror images of the components for right skate 32, as discussed below.

Skate 32 includes forward or toe end 38 and spaced rearward or heel end 40. Skate 32 generally includes medial side M and lateral side L for reference. Skate 32 further has transverse axis T and longitudinal axis L.

Figure 3:
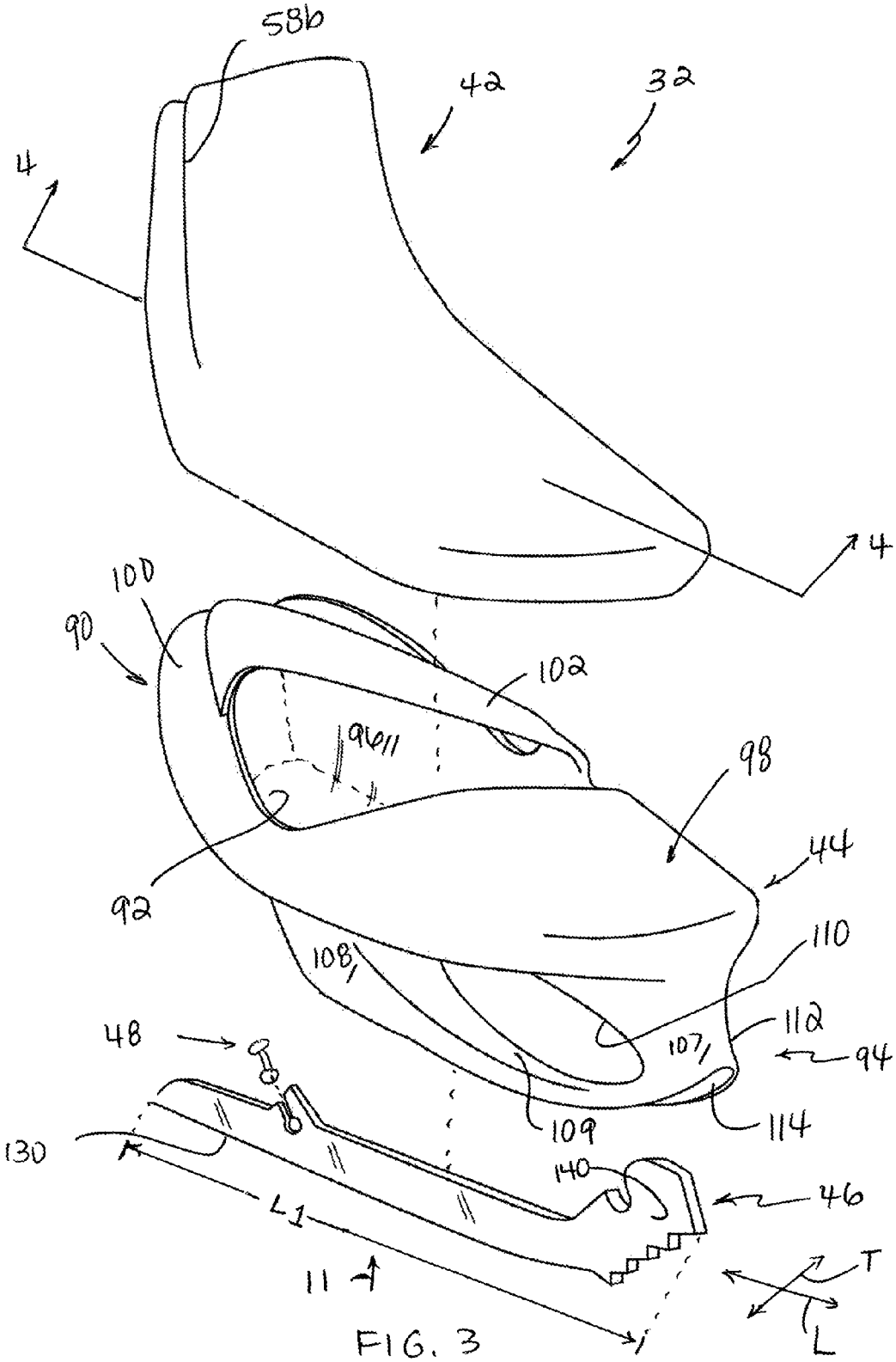
FIG. 3 is an exploded, front, perspective view of the right ice skate of FIG. 2.
Figure 4:
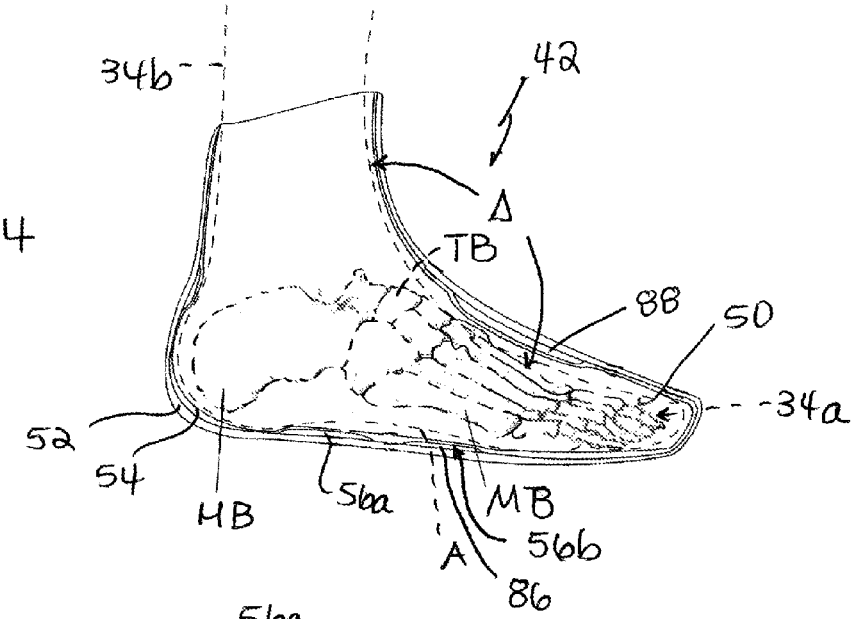
FIG. 4 is a cross-sectional view of the boot of FIG. 3 along line 4-4 of FIG. 3.

Referring to FIGS. 2-3, skate 32 includes boot 42, casing 44, blade 46, and fastener 48. Referring to FIG. 4, boot 42 defines boot chamber 50 for receiving right foot and leg 34*a,b* (shown in phantom). Boot 42 includes outer layer 52, inner layer 54, and intermediate layer 56*a,b* therebetween. Outer, intermediate and inner layers 52, 56*a,b* and 54 are preferably bonded together by glue, as known by those of ordinary skill in the art.

Figure 5:
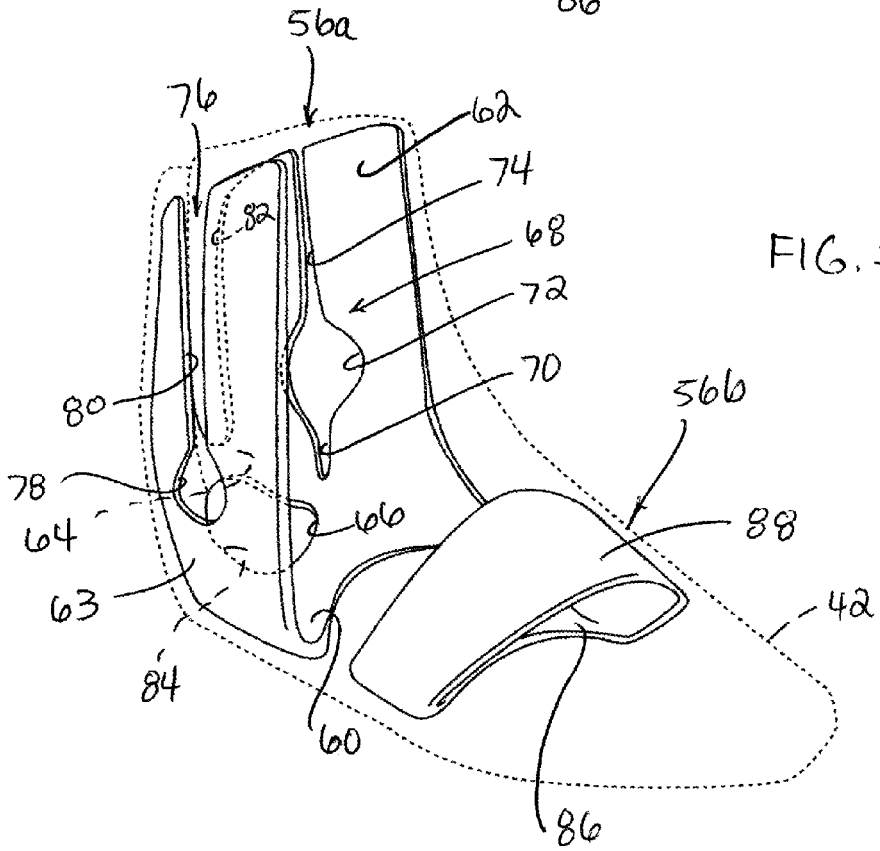
FIG. 5 is a front, perspective view of first and second portions of the boot of FIG. 3.
Figure 5A:
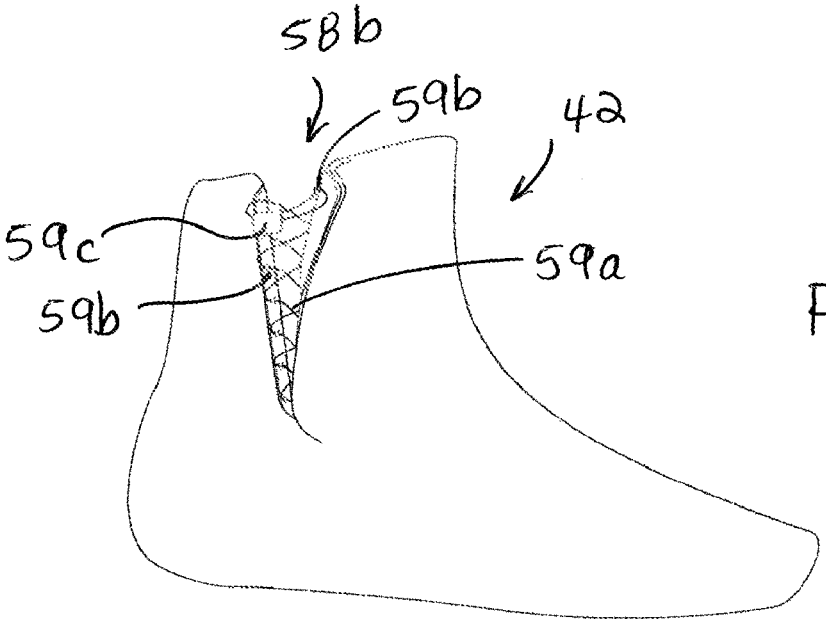
FIG. 5A is a lateral side view of the boot of FIG. 3 where a lace cinched slit is in an open state.

Referring to FIGS. 2, 5A, and 6-7, outer and inner layers 52, 54 include vertically extending medial, lace-cinched slit 58*a* (best seen in FIG. 5A) and lateral, lace-cinched slit 58*b* (shown in FIG. 2). Lace cinched slits 58*a,b* include lace 59*a*, guides 59*b*, and lock 59*c*. Lace 59*a* threads through guides 59*b* to connect both sides of slit 58*a* together. Lock 59*c* can be operated to hold lace 59*a* so that slits 58*a,b* are in an open or closed state. In an open state (as shown in FIG. 5A), there is slack in lace 59*a* to allow upper portion or neck of boot 42 to be selectively enlarged to receive or release skater's foot 34*a* (shown in FIG. 4). In a closed state (as shown in FIG. 3), lace 59*a* (See FIG. 5A) has been tightened so that upper portion or neck of boot 42 is contracted and lock 59*c* is secured so that skater's leg 34*b* (shown in FIG. 4) is securely surrounded by boot 42.

Referring to FIGS. 4-5, intermediate layer 56*a,b* sandwiched between outer and inner layers 52, 54 is formed of two separate, spaced first and second portions 56*a* and 56*b*. First or heel cup portion 56*a* has bottom wall 60 and two side walls 62, 63 joined by curved rear wall 64 (shown in phantom). Bottom wall 60 provides cushioning beneath user's foot 34*a*. Bottom wall 60 includes semicircular cutout 66.

Referring to FIGS. 4-5, medial side wall 62 includes keyhole opening 68 formed by interconnected notch 70, generally circular aperture 72, and slot 74. The configuration of opening 68 allows upper portion of boot 42 to enlarge and contract. In addition, aperture 72 receives a bony protuberance (not shown) on medial side of a user's ankle, at the lower end of the tibia bone (not shown).

Referring to FIGS. 4-5, lateral side wall 63 includes keyhole opening 76 formed by interconnected generally circular aperture 78 and slot 80. The configuration of opening 76 allows upper portion of boot 42 to enlarge and contract. In addition, aperture 78 receives a bony protuberance (not shown) on lateral side of user's ankle, at the lower end of the fibula bone (not shown).

Referring to FIGS. 4-5, curved rear wall 76 includes generally upwardly opening cutout 82 (shown in phantom) and semicircular cutout 84 (shown in phantom). Cutout 82 provides supportive cushioning on either side of the user's Achilles tendon (not shown) and prevents irritation of the Achilles tendon. Semicircular cutout 84 mates with semicircular cutout 66 to define an opening for receiving a portion of user's heel bone HB. Heel cup side and rear walls 62, 63, and 64 encircle, support, and cushion user's foot and leg 34*a,b* and prevent the user's ankle from rolling.

Figure 5B:
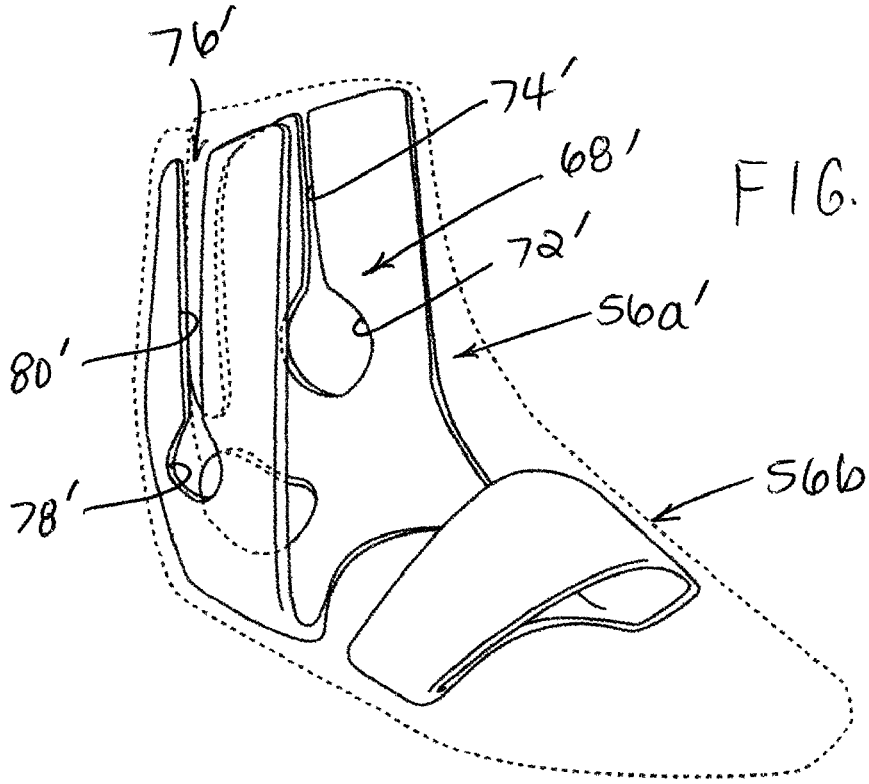
FIG. 5B is a front, perspective view of alternative first and second portions of the boot of FIG. 3.

Referring to FIG. 5B, alternative intermediate layer first portion 56*a*' is shown. First portion 56*a*' includes medial sidewall 62' defining opening 68' formed by generally circular aperture 72' and slot 74'.

Referring to FIGS. 4-5, second or arch portion 56*b* includes bottom wall 86 and integral generally U-shape top wall 88. Thus, arch portion 56*b* loops about user's foot 34*a* with bottom wall 86 there below and top wall 88 there above. Bottom wall 86 of arch portion 56*b* is located adjacent the proximal end of user's arch A (shown in phantom) and distal end of user's metatarsal bones MB (shown in phantom). Top wall 88 is located adjacent user's metatarsal bones MB and tarsal bones TB. Arch portion 56*b* provides stability around user's metatarsal bones M. Arch portion 56*b* can be formed of a single piece of material or multiple pieces of material.

Referring to FIG. 4, outer layer 52 is formed of first boot material. Inner layer 54 is formed of second boot material. Intermediate layer 56*a,b* is formed of third boot material. In the present exemplary boot 42, first, second, and third boot materials have different properties. Third boot material preferably has stiffness greater than the stiffness of first and second boot materials.

First and second boot materials are preferably flexible. First, second and third boot materials are also selected for their comfort, light weight, and able to withstand exposure to moisture. Since first and second boot materials are flexible, and intermediate layer is formed of separate spaced portions 54*a*,56*b*, boot 42 allows maximum plantar flexion or extension of user's foot 34*a*. Plantar flexion or extension occurs when angle Δ between dorsal or upper surface of foot 34*a* and anterior surface of leg 34*b* increases.

First boot material is also selected to be durable, water-repelling, and impact resistant against blade nicks and scratches. For example, synthetic rubber, nylon, polyethylene, polyester, polytetrafluoroethylene (PTFE), or polyurethane can be used for first boot material.

Second boot material is also selected to be comfortable on contact with a user's skin, soft, breathable, anti-bacterial and moisture absorbing. For example, a suede fabric can be used for second boot material.

Third boot material is selected to be durable, rigid and cushioning so that boot 42 is a structural support for skate 32. An exemplary third boot material is high density foam, such as Ethylene vinyl acetate (EVA) foam, polyether foam, or polyurethane foam. First, second, and third boot materials are not limited to the materials disclosed above.

Figure 6:
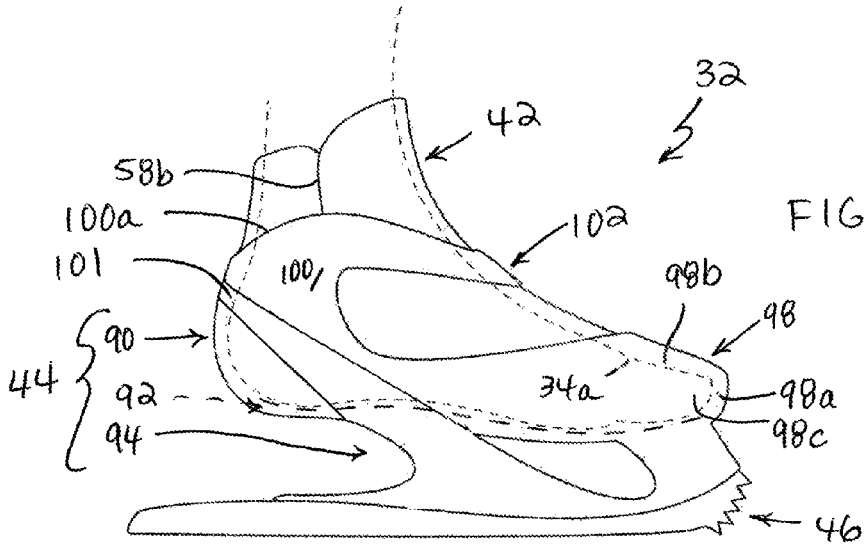
FIG. 6 is a lateral side view of right skate along arrow 6 of FIG. 2.

Referring to FIG. 6, casing 44 includes upper portion 90, sole plate 92 (shown in phantom), and blade holder 94. Casing 44 can have various configurations, as discussed in detail below, for aesthetic appeal.

Figure 7:
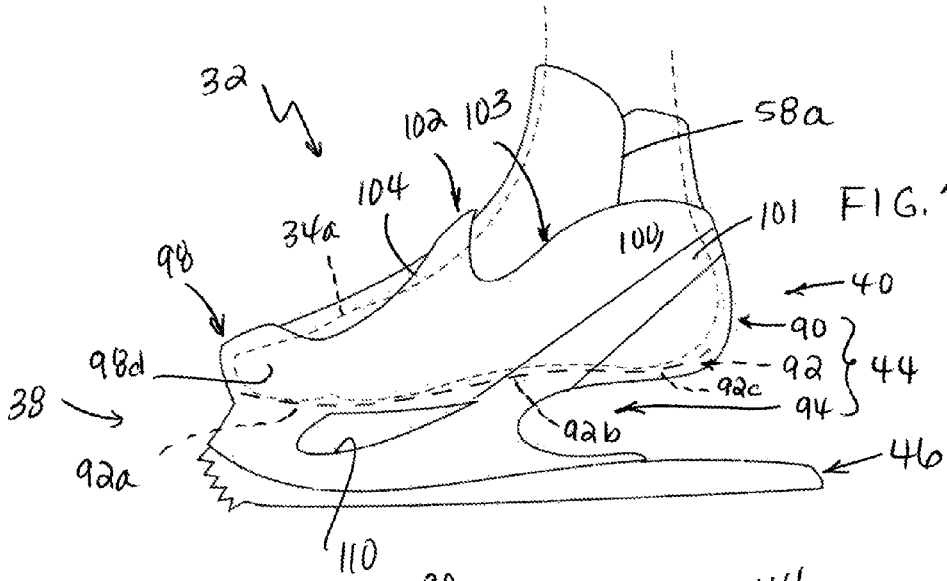
FIG. 7 is a medial side view of right skate along arrow 7 of FIG. 2.

Referring to FIG. 3, upper portion 90 and sole plate 92 form casing chamber 96 for receiving boot 42. Referring to FIGS. 3 and 6-7, upper portion 90 includes toe box 98, spaced apart heel counter 100, and strap 102.

Referring to FIGS. 6 and 7, toe box 98 overlies and surrounds toes of user's foot 34*a* (shown in phantom) to protect them and assist in transmitting forces to blade 46. Toe box 98 includes front wall 98*a* (shown in phantom), top wall 98*b* (shown in phantom), and lateral side wall 98*c*, and medial sidewall 98*d*.

Referring to FIGS. 3 and 4, heel counter 100 encircles heel of user's foot 34*a* (shown in phantom) and provides support to user's ankle preventing movement in transverse direction T. With further reference to FIGS. 6 and 7, heel counter 100 is a solid wall extending from top edge 100*a* to sole plate 92 (shown in phantom). Heel counter 100 further includes decorative strap 101 that extends from medial to lateral edge of sole plate 92 around heel counter 100. Strap 101 is optional.

Figure 8:
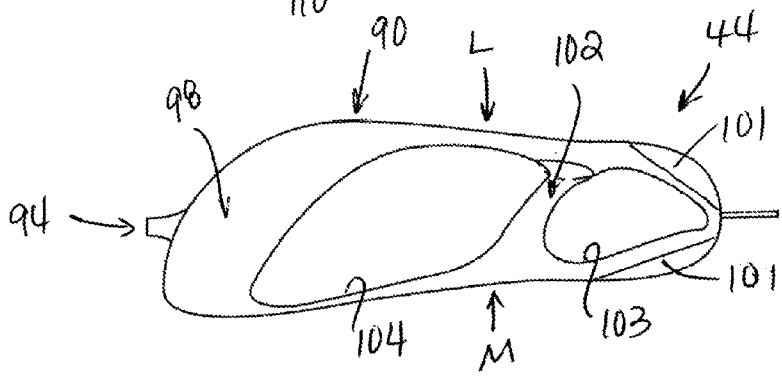
FIG. 8 is a top view of right skate of FIG. 7.

Referring to FIG. 8, strap 102 extends generally transversely across upper portion 90 from medial side M to lateral side L. Opening 103 is defined between heel counter 100 and strap 102 and opening 104 is defined between strap 102 and toe box 98.

Referring to FIG. 7, sole plate 92 (shown in phantom) underlies user's foot 34*a* (shown in phantom) and includes abutting toe, arch and heel areas 92*a*-92*c*, respectively. Sole plate 92 is configured to have a cantilevered connection to blade holder 94. In a cantilevered connection, one end of sole plate 92 is fixed and another end of sole plate 92 is not fixed. Sole plate 92 is fixed to blade holder 94 and supported thereby at toe and arch areas 92*a* and 92*b*. Sole plate 92 is detached from blade holder 94 and unsupported thereby in heel area 92*c*. As a result, sole plate 92 at heel end 40 is free to flex vertically allowing heel of user's foot 34*a* to move vertically during use of skate 32, as discussed in detail below.

Figure 1:
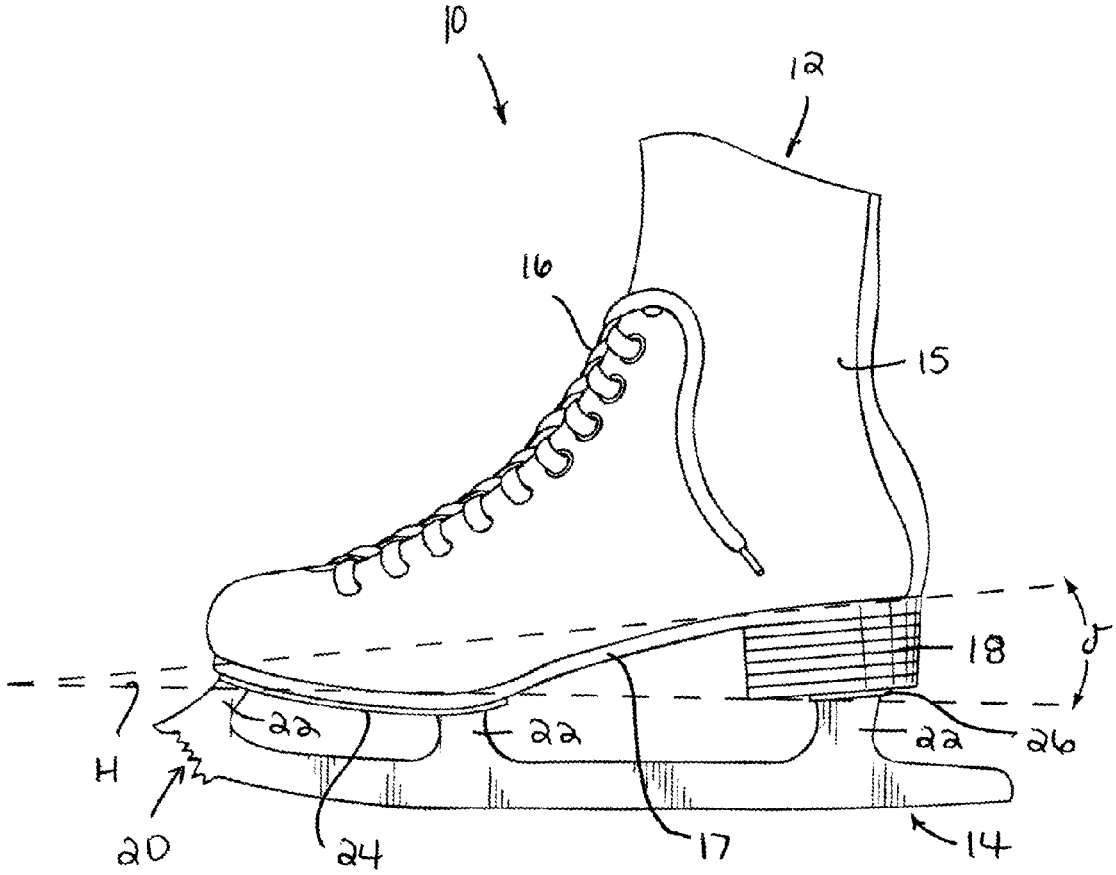
FIG. 1 PRIOR ART
FIG. 1 is a side view of a prior art figure skate.
Figure 9:
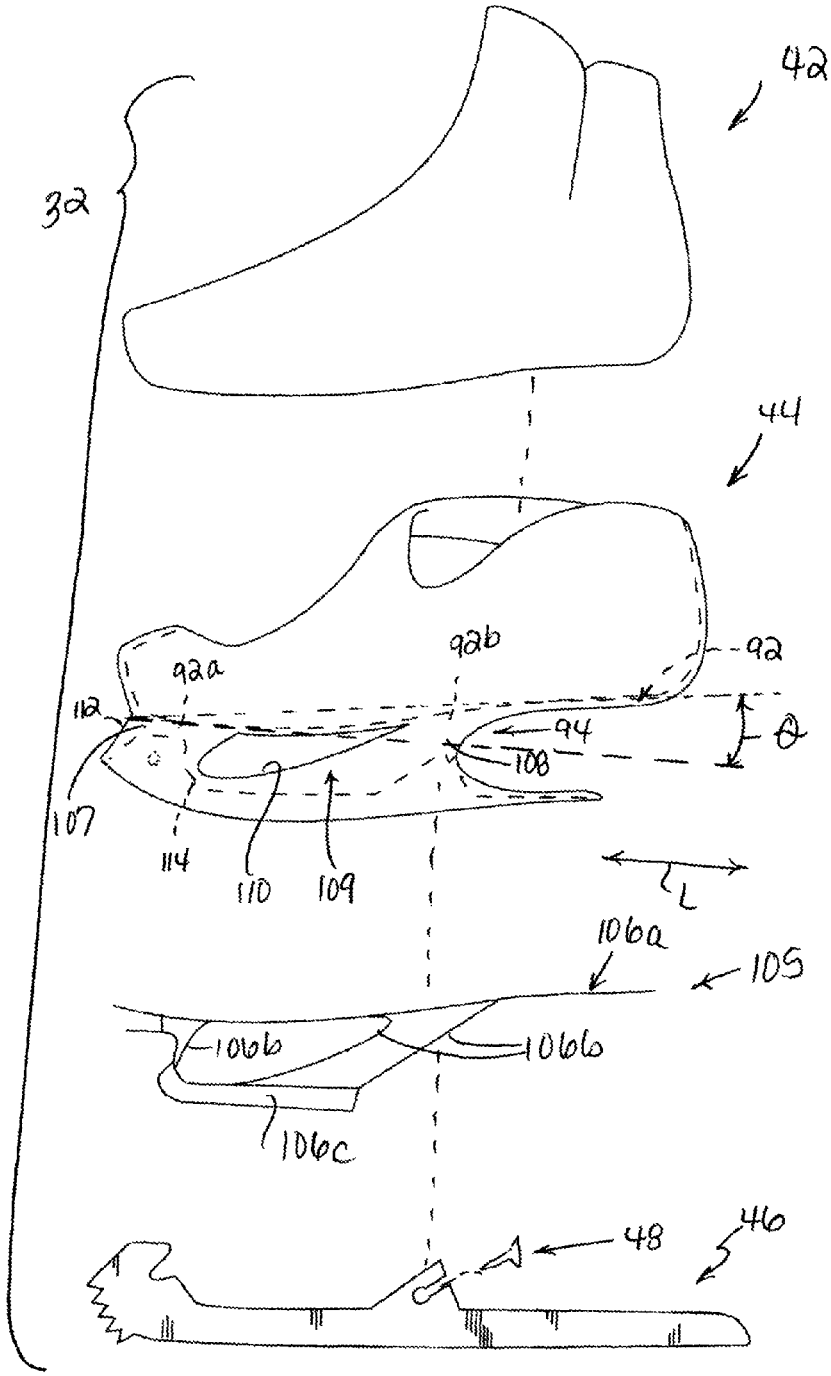
FIG. 9 is an explode, medial view of skate of FIG. 7.

Sole plate 92 has a gradual S-shape from toe end 38 to heel end 40. Referring to FIG. 9, S-shaped curve allows skate 32 to have pitch angle θ between top surface S of sole plate 92 and a horizontal plane H parallel to the ground/ice of between about 2 degrees to about 7 degrees. Moreover, sole plate achieves pitch angle θ without conventional heel 18 (as shown in FIG. 1).

Referring to FIGS. 9 and 9A-9B, sole plate 92 further includes heat conduit assembly 105. Heat conduit assembly 105 includes foot bed 106*a* electrically connected to wires 106*b* and sheet 106*c*. In the present example, foot bed 106*a* is formed on top of sole plate 92. Alternatively, foot bed 106*a* can be incorporated into a separate insole or woven into inner layer 54 (See FIG. 4) of boot 42.

Wires 106*b* extend through sole plate 92 and blade holder 94 (as best seen in FIG. 9A). Sheet 106*c* is draped over sides and top of blade 46 (as best seen in FIG. 9A) to allow more heat dispersion. Foot bed 106*a*, wires 106*b* and sheet 106*c* are formed of lightweight material with a higher thermal conductivity than steel, such as copper.

As shown in FIGS. 9C and 9D, heat H1 from user's foot 34*a*, which is generated during skating, is rapidly transferred to blade 46 from foot bed 106*a* along wires 106*b* to sheet 106*c* and then blade 46, as illustrated by heat arrows H2. As a result, heat built up in foot 34*a* is dispersed to blade 46, melting the ice, and reducing stroking friction. Since blade has pitch angle θ (shown in FIG. 9), skater is balanced on the front of blade 46 most of the time and heat H2 is concentrated generally in forward portion P (See FIG. 9D) of blade 46.

Referring again to FIGS. 3 and 9, blade holder 94 includes first and second supports 107, 108 joined by neck portion 109. Opening 110 is defined between first and second supports 107, 108, sole plate 92 and neck portion 109. First support 107 is fixedly connected to toe area 92*a* of sole plate 92 and second support 108 is fixedly connected to arch area 92*b* of sole plate 92. First support 107 includes front wall 112. First and second supports 107, 108 and neck portion 109 define downwardly opening slot 114. Slot 114 extends along longitudinal axis L along length of blade holder 94. When heat conduit assembly 105 is assembled into casing 44, sheet 106*c* runs along generally the front half of slot 114.

Referring to FIG. 10, slot 114 includes forward slot recess 116, rearward slot recess 118, and bore 120. Forward slot recess 116 is toward toe end 38 of casing 44 and is an enlarged area of slot 114. Rearward slot recess 118 is adjacent arch A and is an enlarged area of slot 114. Bore 120 extends from rearward slot recess 118 to exterior surface 122 of blade holder 94. Blade holder 94 further includes pin 124 in forward slot recess 116 that extends transversely (along axis T shown in FIG. 3).

Referring to FIG. 10, upper portion 90 except for front wall 98*a* of toe box 98 is formed of first plastic material. Consequently, top wall 98*b*, sidewalls 98*c,d* (shown in FIGS. 6 and 7), strap 101 (See FIGS. 6-7), strap 102, and heel counter 100 are formed of first plastic material. Front wall 98*a*, sole plate 92, and blade holder 94 are formed of second plastic material different from first plastic material. Thus, casing 44 is formed of plastic.

In the present example, first plastic material and second plastic material have different properties. In the present example, first plastic material is more flexible than second plastic material, as a result the majority of upper portion 90 is more flexible than sole plate 92 and blade holder 94. Flexibility of first plastic material allows casing 44 to receive boot and expand and contract when a user inserts or removes his or her foot 34*a* (shown in phantom). In another example, first and second plastic materials can have other different properties such as color or level of transparency or opacity.

In the present example, first plastic material is a durable, semi flexible material and second plastic material is a more durable than first plastic material, has a higher strength than first plastic material, is more rigid or less flexible than first plastic material, and non-moisture absorbing material. Exemplary first plastic materials include silicone-type materials, polyethylene, polypropylene, or EVA. Exemplary second plastic materials include EVA-type plastic, polypropylene, Acrylonitrile butadiene styrene (ABS), or PTFE. First and second plastic materials are not limited to these materials.

Referring to FIG. 10, casing 44 is integrally formed so that upper portion 90, sole plate 92, and blade holder 94 are co-molded of first and second plastic materials. The co-molding process includes injecting first plastic material into a mold and then second plastic material is injected into the same mold, as known by those of ordinary skill in the art. Alternatively, casing 44 is formed by reaction injection molding, compression molding, or other conventional means known in the plastics industry and prior art. This results in one integral part rather than forming upper portion 90, sole plate 92 and blade holder 94 of separate parts and fastening them together, such as by mechanical fasteners. In another example, upper portion 90 may be glued or otherwise fastened to sole plate 92 and blade holder 94.

Referring to FIGS. 3 and 10, blade 46 is a figure skate blade. Blade 46 includes upper edge 126, leading edge 128, and lower edge 130.

Upper edge 126 includes forward hook 132 defining recess 134. Upper edge 126 further includes rearward lug 136 defining rearward stepped slot 138. Stepped slot 138 includes enlarged portion 138*a* and narrowed portion 138*b*. Narrowed portion 138*b* has width W.

Forward slot recess 116 of blade holder 94 and forward hook 132 and recess 134 are configured and dimensioned so that slot recess 116 receives hook 132 and pin 124 fits within recess 134. Rearward slot recess 118 and bore 120 of blade holder 94 and rearward blade lug 136 and slot 138 are configured and dimensioned so that rearward slot recess 118 receives blade lug 136 and upon such reception, stepped blade slot 138 is aligned with bore 120 of blade holder 94.

Shape of hook 132 and lug 136 can be modified so long as they create a tight, secure fit of blade 46 within blade holder 94 that does not loosen under the forces present when skating.

Figure 11:
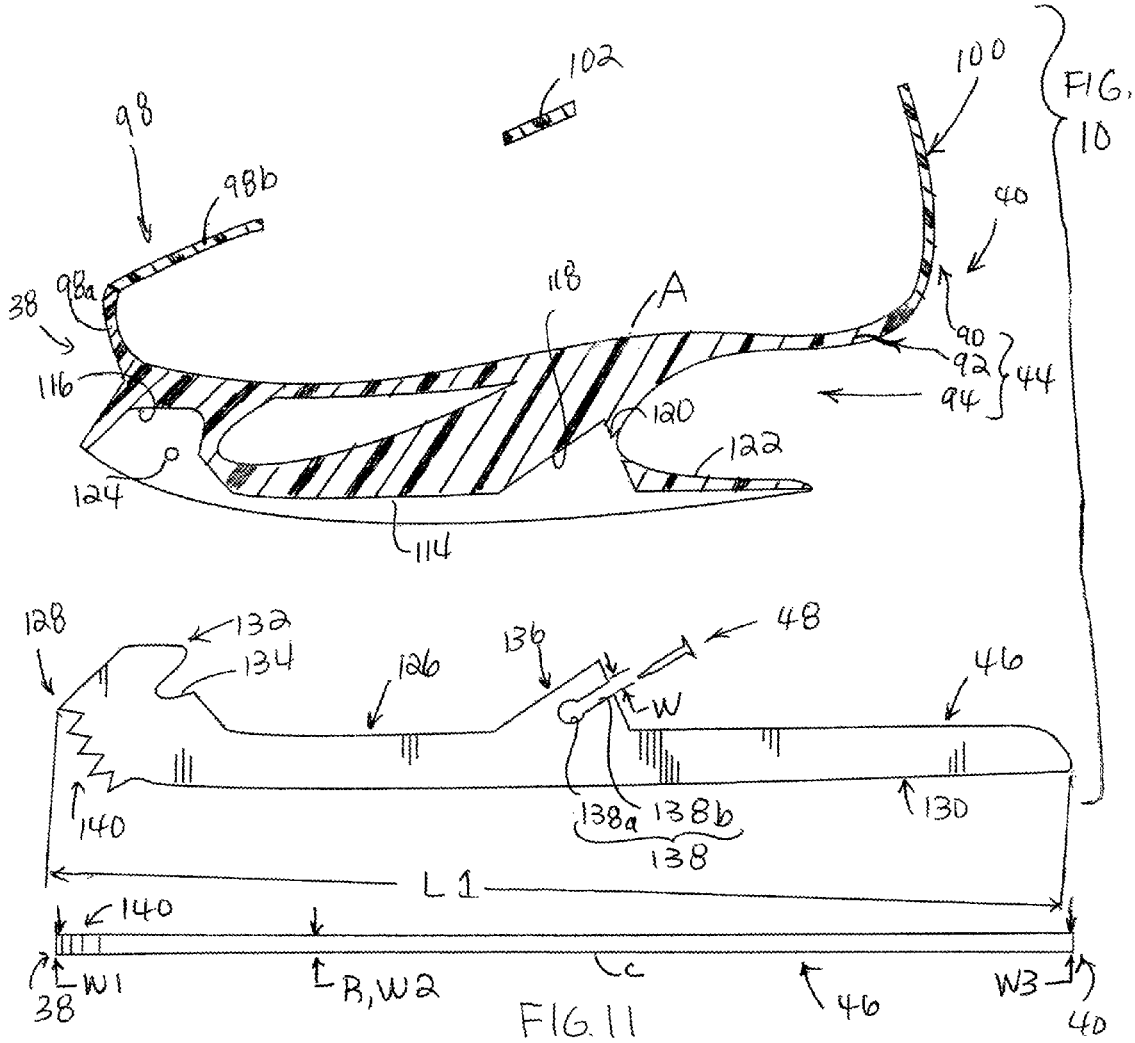
FIG. 11 is a bottom view of blade of FIG. 3 along arrow 11.

As shown in FIG. 11, leading edge 128 includes toe pick 140 with one or more protruding teeth members. When a skater is performing various skate maneuvers that require lift or take off, toe pick 140 is a first point of engagement between skate blade 46 and the ice surface. These maneuvers include certain actions while air-borne, such as rotating or spinning. Examples of such maneuvers include jumps, toe loops, flips, and lutzes (commonly referred to as the toe loop, the flip and the lutz, of the double, triple and quadruple variety). Toe pick 140 is shown with an exemplary pattern, as known by those of ordinary skill in the art, blade 46 is not limited to the pattern shown on toe pick 140 and any other pattern can be used, as known by those of ordinary skill in the art.

Referring to FIG. 3, lower edge 130 of blade 46 contacts an icy surface (not shown) so that skate 32 glides there over. Lower edge 130 is configured to be curved with a conventional radius of curvature. For example, blade 46 can be sharpened to have a 7-foot radius on lower edge 130 that flattens out a little towards heel end 40 for stability. This provides a pivot point (See FIG. 11) under the ball of the foot at rocker apex R (See FIG. 11) at the lowest point of the radius of lower edge 130.

Referring to FIG. 11, blade 46 further includes an optional parabolic width, where the blade width varies along the length. Width of blade 46 at toe end 38 is W1. Width of blade 46 under the ball of the foot is W2. Width of blade 46 at heel end 40 is W3. In the present example, widths W1 and W3 are greater than width W2. Blade 46 narrows from width W1 to width W2 and blade 46 narrows from width W3 to width W2. In the present example, narrowest width W2 of blade 46 occurs in a front portion of the blade, which is spaced from toe end 38 of the blade beneath the ball of a user's foot and spaced from center C of blade 46 toward toe end 38 of blade 46. In the present example, narrowest width W2 occurs at the same point as rocker apex R to amplify placement of pivot point forward of blade center C.

Width of blade 46 can gradually taper in a linear manner from widths W1 and W3 towards width W2. Alternately, width of blade 46 can taper gradually in a non-linear manner from widths W1 and W3 towards width W2 to form an arcuate or curved configuration. Further, width of blade 46 can be asymmetrical, that is, average blade width from width W1 to W2 can be different from the average blade width from width W2 to W3.

The parabolic blade width allows more maneuverability where blade 46 most frequently contacts the ice, rocker apex R of lower edge 130, just below the ball of the foot. This is beneficial for certain movements, such as spinning, quickly changing direction, and movements called "footwork." Having widths W1 and W3 at toe and heel ends 38 and 40, respectively, greater than width W2 keeps the skater stable in other movements, such as landing jumps, gliding, and stroking. Alternatively, blade 46 may have a constant width along the length.

Referring to FIG. 10, blade 46 and slot 114 are configured and dimensioned so that slot 114 is fractionally larger than width of blade 46 as a result there is a frictional fit between blade 46 and blade holder 94. If blade 46 has a parabolic width, then slot 114 has a matching parabolic width profile to receive blade 46 is a mating arrangement. If blade 46 has a constant width, then slot 114 has a constant width to receive blade 46.

Blade 46 can be made of metal such as steel, stainless steel, titanium, carbon steel. Alternatively, blade 46 can be made of ceramic. In addition, blade 46 can be formed of plated materials, such as steel plated with chrome. Blade 46 is not limited to these materials and other conventional blade materials, as known by those of ordinary skill in the art may also be used.

Blade 46 made of metal can be formed by cutting sheet stock of metal material, cutting with the use of electric, gas, plasma, water, or laser cutting equipment, die stamping or forging metal material under heat and pressure, casting, die casting, or employing other conventional means known in the metal working industry and prior art. Ceramic blades can be formed using conventional means as known by those of ordinary skill in the art.

Since blade 46 (See FIG. 3) lacks steel toe and heel plates 24, 26 and steel stanchions 22 of prior art blade 14 (shown in FIG. 1), blade 46 is lightweight and easily replaceable. Blade 46 weighs about 2.5 ounces to about 4.5 ounces.

Referring to FIG. 7, in the present example, blade holder 94 terminates spaced from heel end 40 of blade 46. Alternatively, blade holder 94 may extend the entire length of blade 46.

Figure 12:
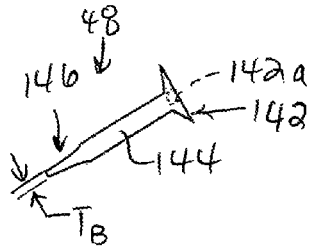
FIG. 12 is a side view of fastener of FIG. 3 in an unlocked position.

Referring to FIGS. 3 and 12, fastener 48 is shown. Fastener 48 is integrally formed of metal and includes head 142, shaft 144 and boss 146. Head 142 includes at least one groove 142*a* (shown in phantom) useful with a Phillips or flat head screwdriver, as known by one of ordinary skill in the art.

Figure 13:
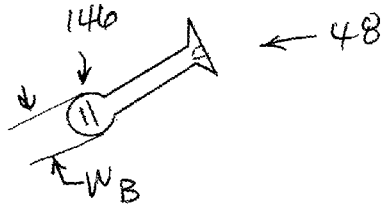
FIG. 13 is a side view of fastener of FIG. 12 in a locked position.

Referring to FIGS. 12 and 10, in unlocked or installation/removal position boss 146 has thickness $T_B$ less than width W of narrowed portion 138*b* of stepped slot 138 (as shown in FIG. 10). Referring to FIGS. 13 and 10, in locked position boss 146 has width $W_B$ greater than width W of narrowed portion 138*b* of stepped slot 138.

Figure 10A:
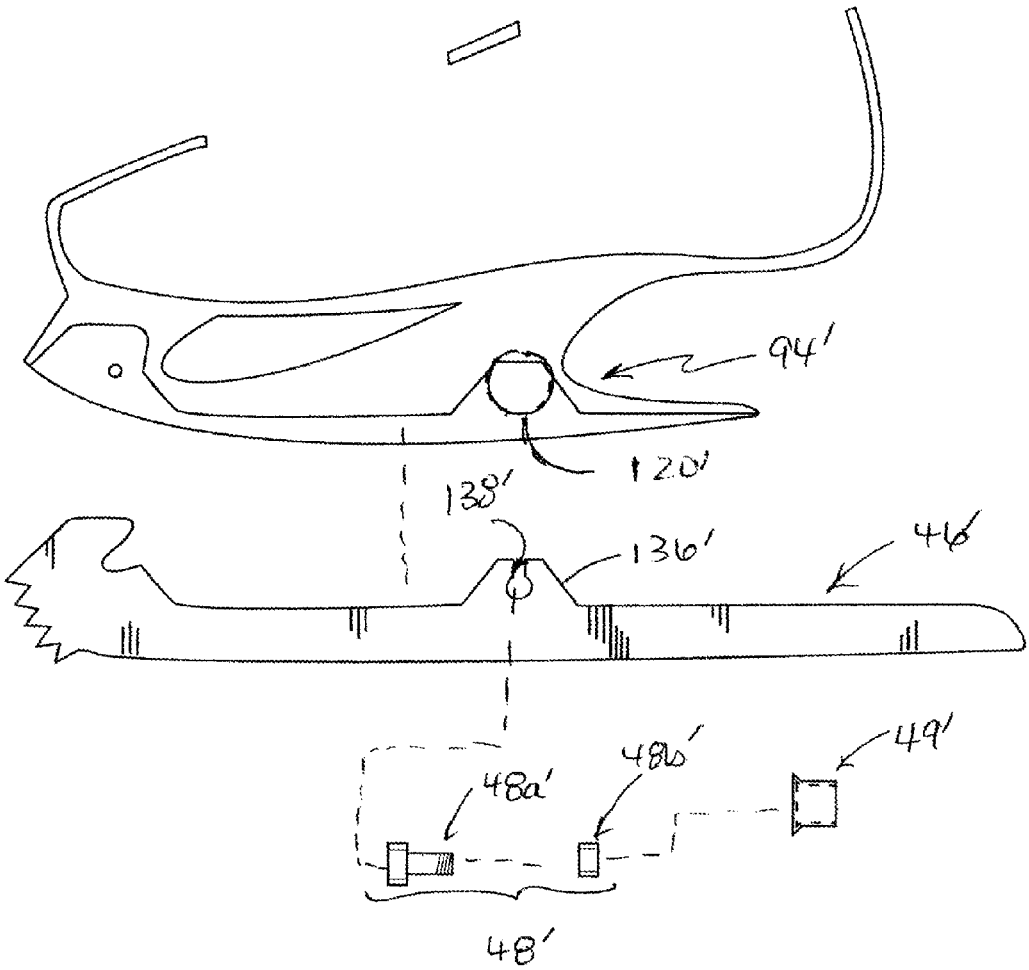
FIG. 10A is a cross-sectional view of casing, modified blade and alternative fastener in an uninstalled state.
Figure 10B:
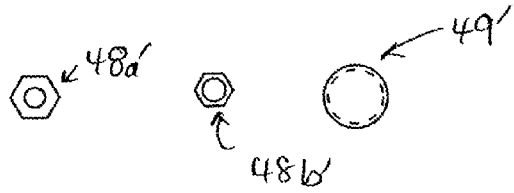
FIG. 10B is an end view of alternative fastener and cap.

Referring to FIGS. 10A-B, alternatively slot 120' may open through a side surface of holder 94' and fastener 48' may be hardened bolt 48*a'* with lock nut 48*b'* that are received into alternative slot 120' in a transverse direction T. Blade 46' has lug 136' with stepped slot 138' for receiving bolt 48*a'*. In addition, alternative fastener 48*a'* may be used with plastic cap 49' that is received within slot 138' and rests flush with the side surface of holder 94' to hide fastener 48*a'* for aesthetic reasons. Fasteners 48 and 48' and blade holder 94 and 94' are configured to cooperate and hold blade 46 and 46' to holder 94 and 94' respectively. Skate 32 (shown in FIG. 2) is not limited to fastener 48 and blade holder 94 disclosed.

Figure 14:
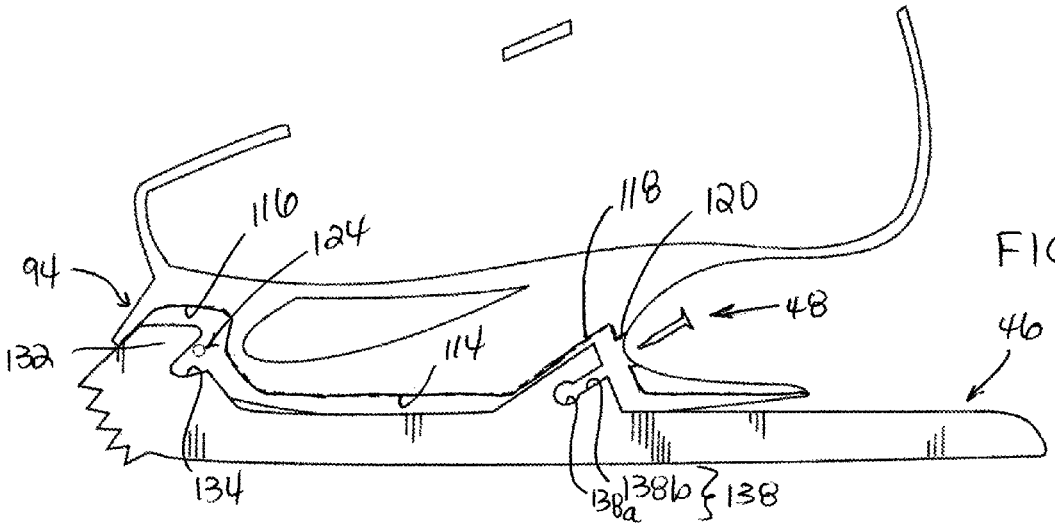
FIG. 14 is a cross-sectional view of casing, blade, and fastener of FIG. 10 with blade in a partially installed state.
Figure 15:
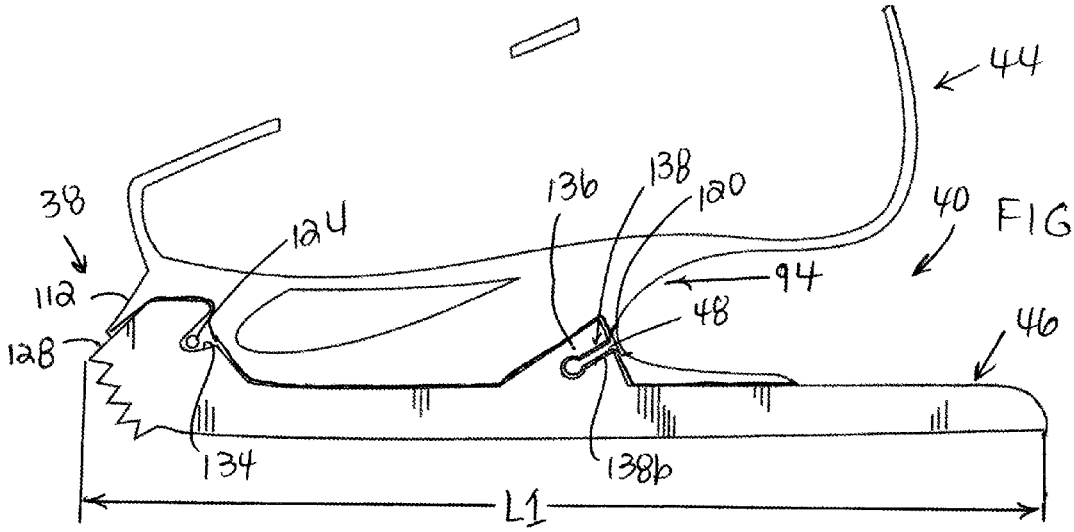
FIG. 15 is a cross-sectional view of casing, blade, and fastener of FIG. 10 with blade in a fully installed state.

Installation of blade 46 will now be discussed with reference to FIGS. 10 and 14-15. To connect blade 46 to blade holder 94, user inserts forward hook 132 of blade 46 into forward slot recess 116 of blade holder 94, so that blade recess 134 mates with pin 124 (as shown in FIG. 14). User also moves blade rearward lug 136 into rearward slot recess 118. Thus, aligning stepped blade bore 138 with bore 120 (as shown in FIG. 15). As a result, blade 46 is received in blade holder slot 114 and nested therein.

With fastener 48 in unlocked position, as shown in FIGS. 12 and 14, a user guides fastener 48 into blade stepped slot 138. Since boss thickness $T_B$ is less than width W of narrowed portion 138*b* of stepped slot 138, fastener 48 can be installed. A user then rotates fastener 48 forty-five degrees to locked position (as shown in FIGS. 13 and 15) using screwdriver (not shown) and groove 142*a* (shown in phantom). In locked position, width $W_B$ is greater than width W of narrowed portion 138*b* of stepped slot 138. As a result, fastener 48 cannot be removed from stepped slot 138 without rotation to unlocked position, and blade 46 is removably connected to blade holder 94 of casing 44.

Referring to FIG. 15, blade 46 hooks in front and is tightened to blade holder 94 in the rear. The front of blade 46 is secured from forward movement by front wall 112 extending over leading edge 128 of blade 46. Front wall 112 and leading edge 128 are particularly configured and dimensioned to withstand forward forces during jump take off and landing. Toe pick 140 is uncovered by front wall 112 in installed position. Front of blade 46 is also secured from rearward movement by engagement with pin 124.

The rear of blade 46 is secured from forward movement by fastener 48. The rear of blade 46 is secured from rearward movement by engagement of lug 138 with blade holder 94. As a result, blade 46 is removably locked to blade holder 94.

To remove blade 46, user rotates fastener 48 forty-five degrees to unlocked position (shown in FIGS. 12 and 14) and removes fastener 48 from bore 138. Then, blade 46 can easily be lowered from slot 114.

Figure 16:
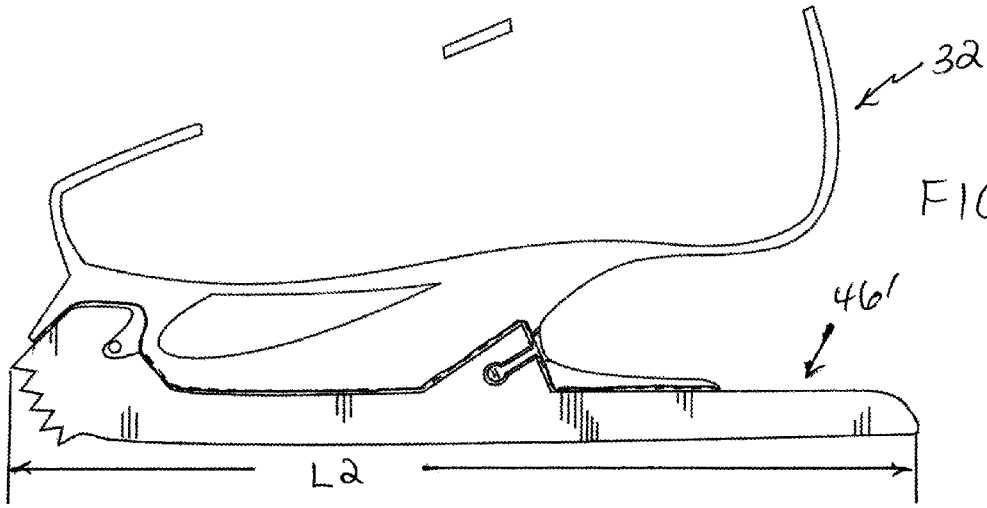
FIG. 16 is a cross-sectional view of casing and fastener of FIG. 10 with an alternative blade in a fully installed state.

Referring to FIGS. 2, 15 and 16, the actual dimensions of skate 32 may vary depending upon the size of skate 32. In exemplary skate 32, which is a women's size 7, blade 46 has conventional length L1 of 12 inches. Alternatively, skate 32 can be used with blade 46', which has conventional length L2 of 11.25 inches. Thus, blades 46 and 46' are interchangeable. Skate 32 can be purchased pre-assembled with blade 46 or blade 46' already installed or purchased without blades 46, 46'.

Figure 17:
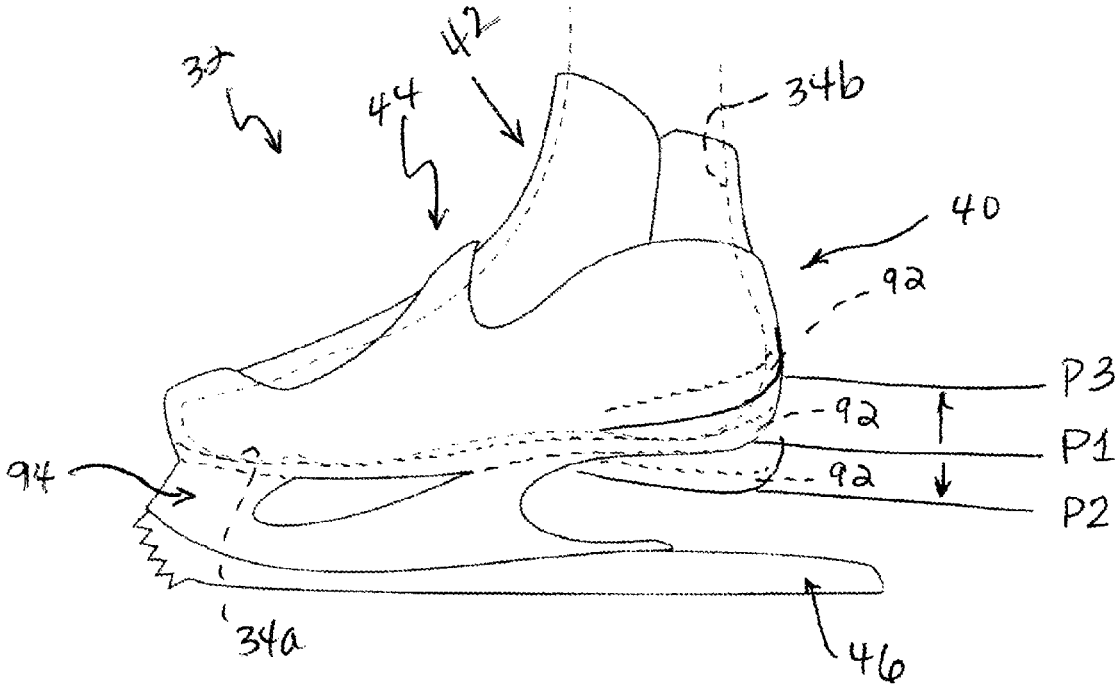
FIG. 17 is a medial side view of the skate of FIG. 7 showing the skate in use.

Skate 32 is shown in use in FIG. 17. In use, boot 42, user's heel H, and rear end of casing 44 are vertically movable due to sole plate 92 vertically flexing.

Sole plate 92 is shown in initial position P1. Second plastic material and cantilevered configuration of sole plate 92 allow a predetermined amount of vertical flex. Flex must be limited so that sole plate 92 provides ample support to user's foot 34*a* and leg 34*b* (shown in phantom). Sole plate 92 is configured and dimensioned and made of a material so that sole plate 92 only flexes with extreme forces, such as jump landings.

Sole plate 92 is shown in downward position P2, which is exemplary of performance during a landing. This allows for shock absorption of some of landing forces. In position P2, sole plate 92 is closer to blade 46 than in initial position P1. Sole plate 92 is shown in elevated position P3, which is exemplary of performance during take off. In position P3, sole plate 92 is farther to blade 46 than in initial position P1. During stopping actions, intense lateral forces are imparted on skate 32 that casing 44 and blade holder 94 must withstand.

Maintenance of skate 32 includes checking tightness of fastener 48, sharpening blade 46, and drying internal and external moisture on boot 42 and blade 46.

Figure 18:
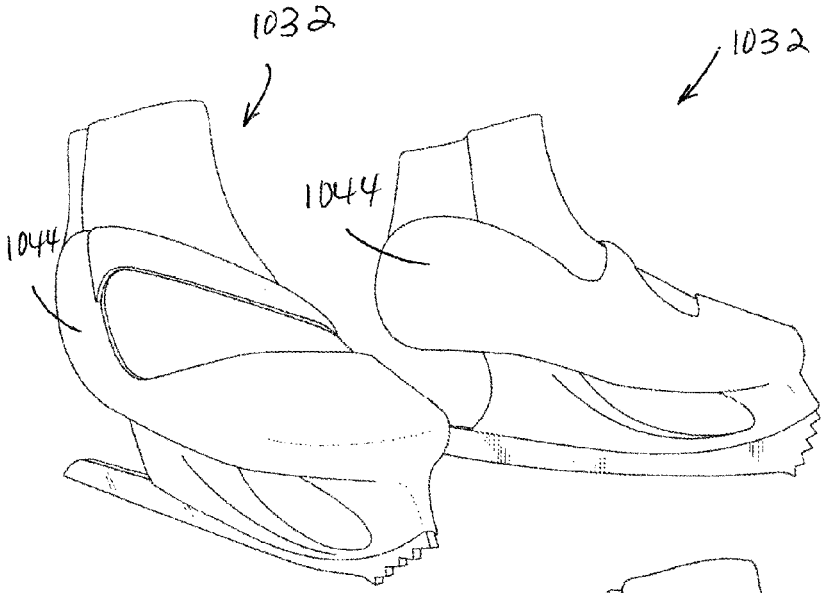
FIG. 18 is a front, perspective view of a second example of a pair of ice skates.
Figure 19:
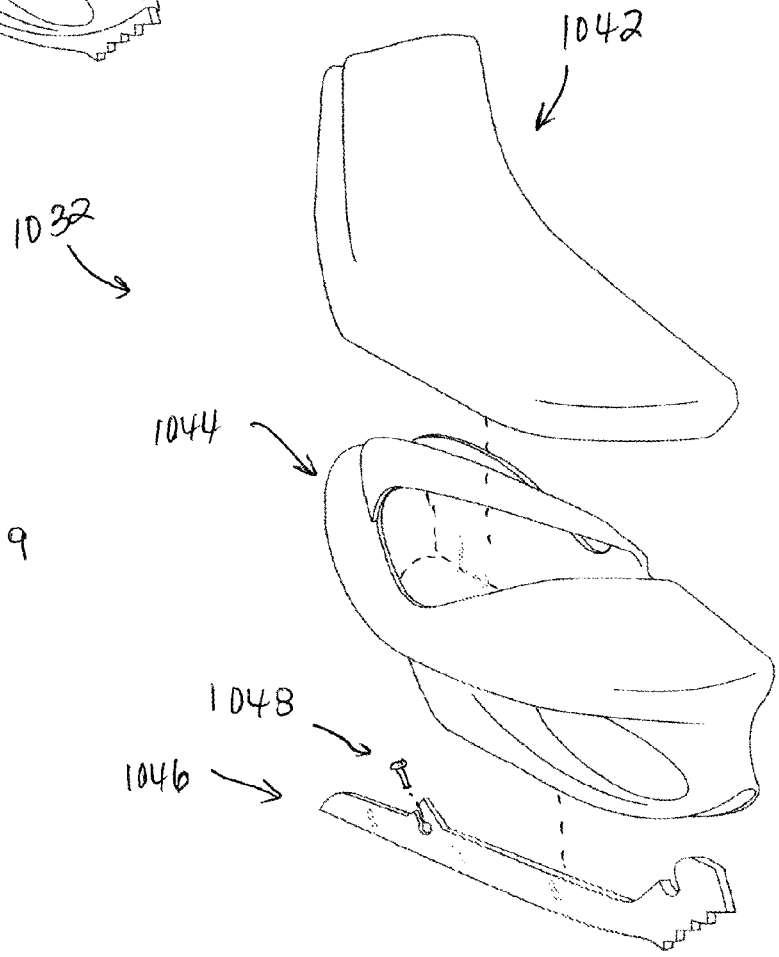
FIG. 19 is an exploded, front, perspective view of the right ice skate of FIG. 18.

Referring to FIGS. 18-19, second exemplary pair of skates 1032 is shown. Skates 1032 are similar to skates 32 of FIG. 2 except casings 1044 of skates 1032 lack decorative strap 101 (See FIGS. 2 and 6-7). Skates 1032 include boot 1042, casing 1044, blade 1046 and fastener 1048, as previously discussed with respect to skate 32 of FIGS. 2-17.

Referring to FIGS. 20-23, a third example of skate 2032 is shown similar to skates 32 and 1032. Skate 2032 includes boot 2042, casing 2044, blade 2046 and fastener 2048. Boot 2042, blade 2046, and fastener 2048 are similar to boot 42, blade 46 and fastener 48, respectively, previously discussed with respect to skate 32 of FIGS. 2-17.

Casing 2044 has been modified for aesthetic purposes to be more open than casing 44. Casing 2042 has a more open upper portion 2090 while sole plate 2092 and blade holder 2094 are similar to sole plate 92 and blade holder 94, previously discussed.

Figure 21:
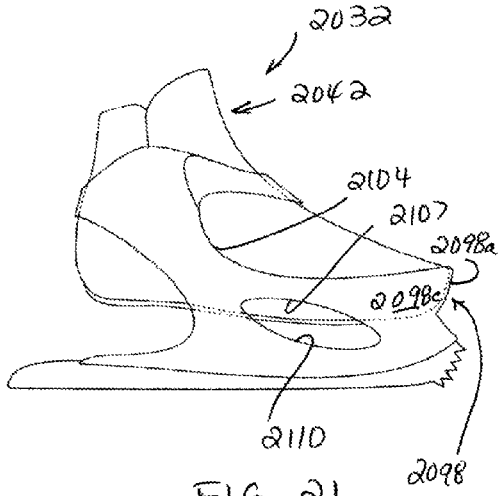
FIG. 21 is a lateral side view of skate of FIG. 20.
Figure 22:
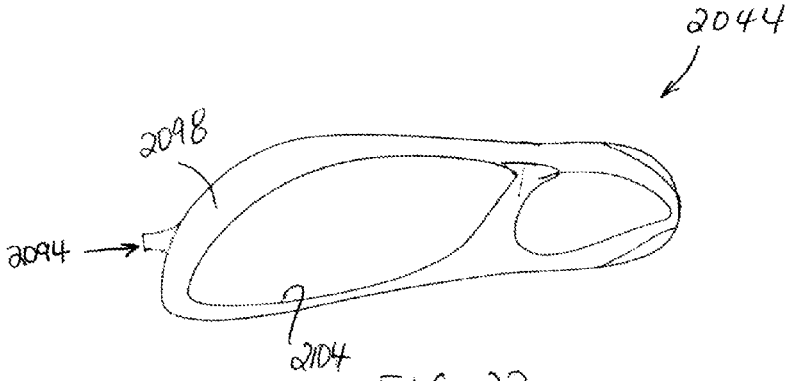
FIG. 22 is a top view of the casing of the skate of FIG. 20.

Upper portion 2090 has reduced toe box 2098 as compared to toe box 98 (as best seen with reference to FIGS. 22 and 8). Toe box 2098 includes front wall 2098*a* and sidewalls 2098*c*, *d*. Referring to FIG. 21, upper portion 2090 has larger opening 2104 as compared to opening 104 of casing 44. As a result, more of boot 2042 is visible through opening 2104.

Figure 20:
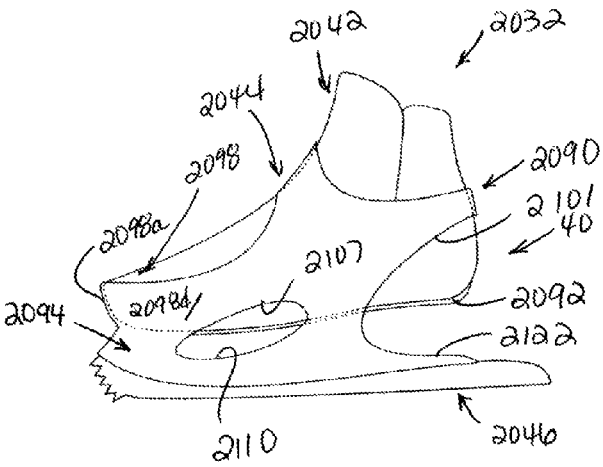
FIG. 20 is a medial side view of a third example of a right ice skate.
Figure 23:
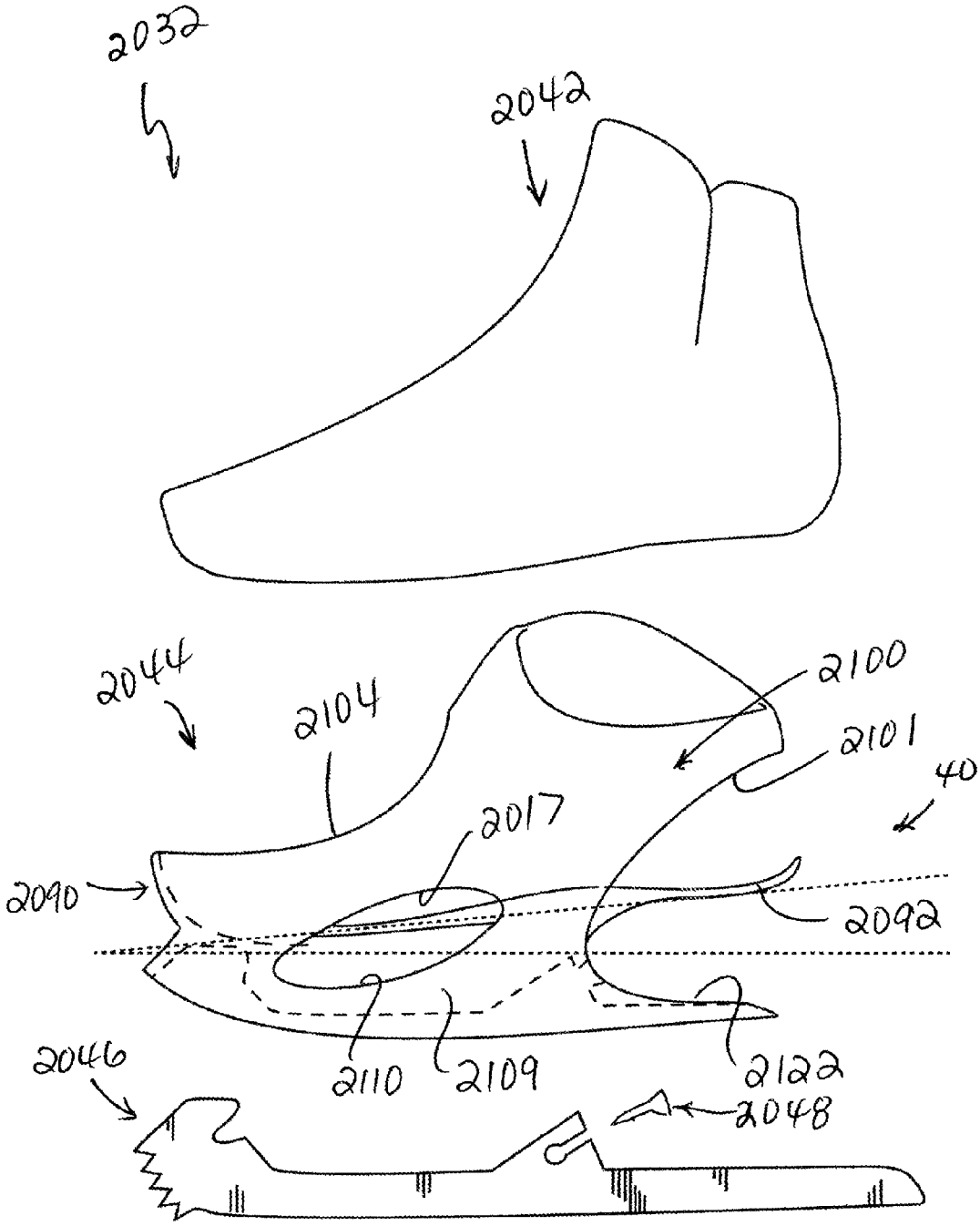
FIG. 23 is an exploded, medial side view of the skate of FIG. 20.

Medial and lateral sides of skate 2032 (as shown in FIGS. 20-21 and 23) each include cutout 2107 that mates with opening 2110 formed by sole plate 2092 and neck portion 2109. As a result, an oval opening is formed on each side of skate 2032 as compared to the partial oval opening 110 formed on skate 32 (as best seen comparing FIGS. 20 and 7).

Referring to FIG. 23, heel counter 2100 of skate 2032 includes an opening 2101 that mates with exterior surface 2122 of blade holder 2094 so that sole plate 2092 is visible and exposed at rear end 40. Sole plate 2092 is also visible through opening formed by cutout 2107 and opening 2110.

Figure 24:
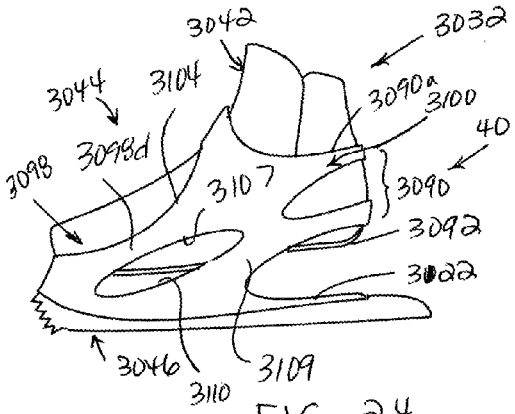
FIG. 24 is a medial side view of a fourth example of a right ice skate.
Figure 25:
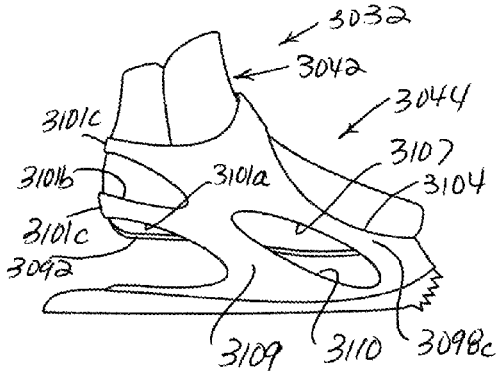
FIG. 25 is a lateral side view of right ice skate of FIG. 24.

Referring to FIGS. 24-25, a fourth example of skate 3032 is shown similar to skate 2032. Skate 3032 includes boot 3042, casing 3044, blade 3046 and fastener (not shown). Boot 3042, blade 3046 and fastener (not shown) are similar to boot 42, blade 46 and fastener 48, respectively, previously discussed with respect to skate 32 of FIGS. 2-17.

Casing 3044 has been modified for aesthetic purposes to be more open than casing 44. Casing 3042 has a more open upper portion 3090 while sole plate 3092 and blade holder 3094 are similar to sole plate 2092 (See FIG. 23) and blade holder 2094, previously discussed.

Upper portion 3090 has reduced toe box 3098 as compared to toe box 98 (as best seen with reference to FIGS. 24-25 and 8). Toe box 3098 includes front wall sidewalls 3098*c*,*d*. Referring to FIGS. 24-25, upper portion 3090 has larger opening 3104 as compared to opening 104 of casing 44. As a result, more of boot 3042 is visible through opening 3104. In addition, top edge 3090*a* of upper portion 3090 is concave in the ankle area.

Medial and lateral sides of skate 3032 (as shown in FIGS. 24 and 25), includes cutouts 3107 that mate with openings 3110 formed by sole plate 3092 and neck portion 3109. As a result, an oval opening is formed on medial and lateral sides of skate 3032.

Referring to FIG. 25, heel counter 3100 of skate 3032 includes openings 3101*a*,*b*. Opening 3101*a* is disposed between two heel straps 3101*c*. Opening 3101*b* mates with exterior surface 3122 of blade holder 3094 so that sole plate 3092 is visible and exposed at rear end 40 (as best seen in FIG. 25). Sole plate 3092 is also visible through opening formed by cutouts 3107 and opening 3110.

Figure 26:
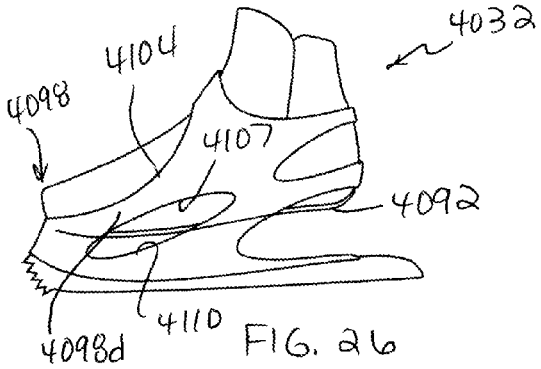
FIG. 26 is a medial side view of a fifth example of a right ice skate.
Figure 27:
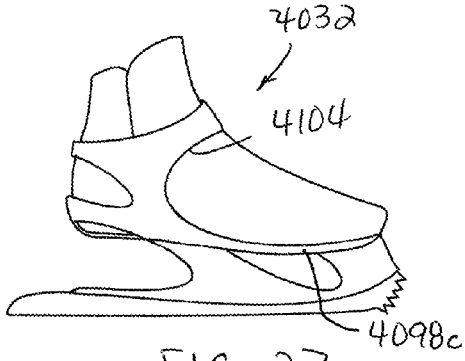
FIG. 27 is a lateral side view of right ice skate of FIG. 26.

Referring to FIGS. 26-27, a fifth example of skate 4032 is shown similar to skate 3032, except skate 4032 includes medial cutout 4107 mating with opening 4110, and no lateral cutout similar to lateral cutout 3107 shown in FIG. 25.

Skate 4032 includes opening 4104 that is larger on the lateral side than on the medial side, as shown comparing FIGS. 26 and 27. Skate 4032 has reduced toe box 4098 formed of sidewalls 4098*c*,*d*.

Figure 28:
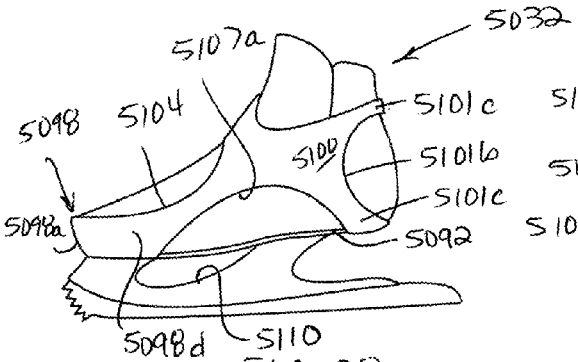
FIG. 28 is a medial side view of a sixth example of a right ice skate.
Figure 29:
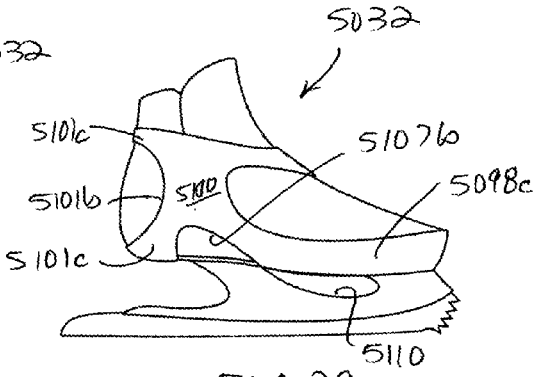
FIG. 29 is a lateral side view of right ice skate of FIG. 28

Referring to FIGS. 28-29, a sixth example of skate 5032 is shown similar to skate 4032, except skate 5032 includes medial cutout 5107*a* larger than lateral cutout 5107*b*. Skate 5032 includes opening 5104 that is larger on the lateral side than on the medial side, as shown comparing FIGS. 28 and 29. Skate 5032 has reduced toe box 5098 formed of front wall 5098*a* and sidewalls 5098*c*,*d*. Opening 5101*b* is configured so that heel counter 5100 has straps 5101*c*. Sole plate 5092 is visible through opening formed by cutout 5107*a* and opening 5110 and visible through cutout 5107*b* and opening 5110.

Figure 30:
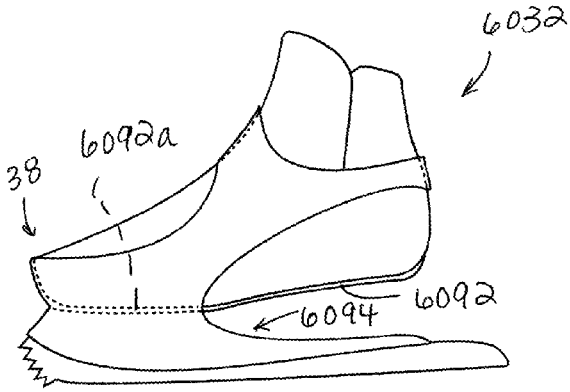
FIG. 30 is a medial side view of a seventh example of a right ice skate.
Figure 31:
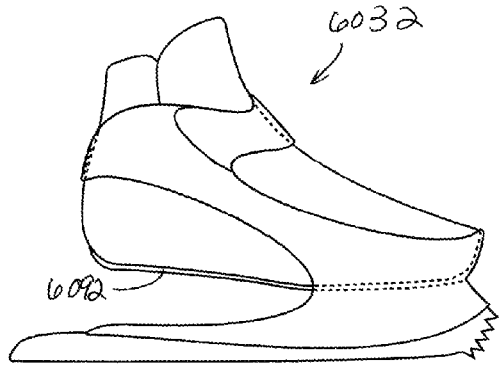
FIG. 31 is a lateral side view of right ice skate of FIG. 30.

Referring to FIGS. 30-31, a seventh example of skate 6032 is shown similar to skate 2032, except skate 6032 includes alternative blade holder 6094. Blade holder 6094 is configured to be connected sole plate 6092 in sole plate toe area

6092*a* (shown in phantom) toward toe end 38 of skate 6032. Thus, cantilever connection is formed by sole plate 6092 being fixed at a single location adjacent the toe area. Sole plate 6092 functions similar to sole plate 92 previously discussed.

Figure 32:
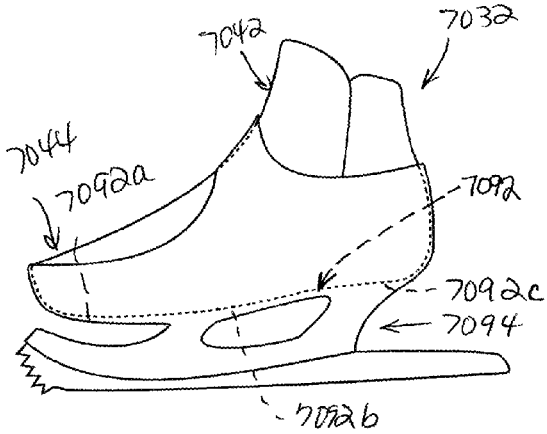
FIG. 32 is a medial side view of a eighth example of a right ice skate.
Figure 33:
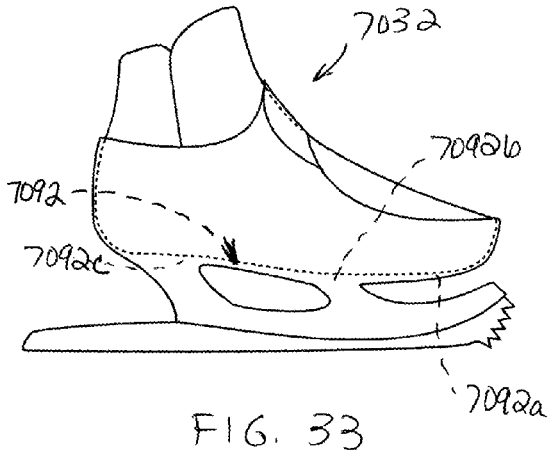
FIG. 33 is a lateral side view of right ice skate of FIG. 32.

Referring to FIGS. 32-33, an eighth example of skate 7032 is shown similar to skate 32, except skate 7032 includes alternative blade holder 7094. Blade holder 7094 is configured to be connected sole plate 7092 (shown in phantom) in sole plate arch area 7092*b* (shown in phantom) and heel area 7092*c* (shown in phantom) so that toe end 38 of casing 7044 and boot 7042 are unsupported and toe area 7092*a* (shown in phantom) is free to flex and move vertically. Thus, a cantilever connection is formed by sole plate 7092. Skate 7032 is configured so that vertical flex at the toe occurs during jump take-offs and landings.

Those skilled in the art will appreciate that the conception, upon which this disclosure is based, may readily be utilized as a basis for designing other products. Therefore, the claims are not to be limited to the specific examples depicted herein. For example, the features of one example disclosed above can be used with the features of another example. Thus, the details of these components as set forth in the above-described examples, should not limit the scope of the claims.

Further, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the claims of the application nor is intended to be limiting on the claims in any way.

What is claimed is:

1. An ice skate comprising:

a casing including an upper portion and a sole plate defining a casing chamber for receiving a skater's foot, said sole plate having abutting toe, arch and heel areas, said casing further including a blade holder, said sole plate being supported by said blade holder at said toe area, and said sole plate being unsupported by said blade holder at said heel area; and a blade being removably connected to said blade holder.

2. The ice skate of claim 1, further including said sole plate being supported by said blade holder at said arch area.

3. The ice skate of claim 2, wherein said blade holder includes first and second supports joined by a neck portion, said sole plate being supported by said first support at said toe area and said sole plate being supported by said second support at said arch area.

4. The ice skate of claim 3, wherein said first support of said blade holder includes a front wall, and when said blade is connected to said blade holder said front wall extends over a leading edge of said blade.

5. The ice skate of claim 1, wherein said blade holder further defines a slot and said blade being selectively disposable within said slot.

6. The ice skate of claim 5, wherein said slot includes a forward slot recess, a rearward slot recess, and a slot bore joining said rearward slot recess to an exterior surface of said blade holder, and said blade includes a forward hook defining a recess and a rearward lug and blade slot there through, said forward slot recess and said forward hook being configured and dimensioned to mate and said rearward slot recess and said rearward lug being configured and dimensioned to mate so that said slot bore and said blade slot are aligned.

7. The ice skate of claim 6, wherein said slot further includes a transversely extending pin and when said blade is installed in said slot said pin is received within said recess.

8. The ice skate of claim 6, further including a fastener removably disposable within said slot bore and said blade slot to removably secure said blade to said blade holder.

9. The ice skate of claim 1, further including a fastener for removably connecting said blade to said blade holder.

10. The ice skate of claim 1, wherein said upper portion, said sole plate, and said blade holder are integrally formed.

11. The ice skate of claim 10, wherein said upper portion, said sole plate, and said blade holder are formed of plastic material.

12. The ice skate of claim 10, wherein said upper portion includes a heel counter and a toe box, said toe box including a top wall and a joined front wall, and said heel counter and top wall are formed of a first plastic material, and said front wall, said sole plate and said blade holder are formed of a second plastic material different from said first plastic material.

13. The ice skate of claim 12, wherein said upper portion further includes a strap between said heel counter and said toe box, said strap defining spaced apart openings.

14. The ice skate of claim 1, further including a boot separate from said casing, said boot defining a boot chamber for receiving the skater's foot and being received in said casing chamber.

15. The ice skate of claim 14, wherein said boot includes an outer layer formed of a first boot material, an inner layer formed of a second boot material and an intermediate layer between said outer and inner layers formed of a third boot material, said third boot material having a stiffness greater than said first and second boot materials.

16. The ice skate of claim 1, further including a heat conduit assembly comprising:

a foot bed, wires extending through said sole plate, and a sheet, said foot bed being electrically connected to said wires and said sheet, said sheet being draped over said blade upon installation, wherein during skating heat from a user's foot is transferred from said foot bed along said wires to said sheet and then to said blade.

17. An ice skate comprising:

a casing including an upper portion and a sole plate defining a casing chamber for receiving a skater's foot, said sole plate having abutting toe, arch and heel areas, said casing further including a blade holder, said sole plate being supported by said blade holder at said toe and arch areas, and said sole plate being unsupported by said blade holder at said heel area; and a blade being removably connected to said blade holder.

18. An ice skate comprising:

a boot defining a boot chamber for receiving a skater's foot;

a casing including an upper portion and a sole plate defining a casing chamber for receiving said boot, said sole plate having abutting toe, arch and heel areas, said casing further including a blade holder, and said sole plate having a cantilevered connection to said blade holder such that said heel area is unsupported by said blade holder; and a blade being removably connected to said blade holder.

19. The ice skate of claim 18, wherein said toe and arch areas are supported by said blade holder.

20. The ice skate of claim 18, wherein said blade holder further defines a slot and said blade being selectively disposable within said slot.

21. The ice skate of claim 18, wherein said blade further includes a toe pick.

* * * * *